US011375819B2

(12) United States Patent
Wei

(10) Patent No.: US 11,375,819 B2
(45) Date of Patent: Jul. 5, 2022

(54) CHAIR DEVICE, PROPPING DEVICE, AND MATTRESS DEVICE

(71) Applicant: Hong-Fan Wei, Taipei (TW)

(72) Inventor: Hong-Fan Wei, Taipei (TW)

( * ) Notice: Subject to any disclaimer, the term of this patent is extended or adjusted under 35 U.S.C. 154(b) by 0 days.

(21) Appl. No.: 17/104,254

(22) Filed: Nov. 25, 2020

(65) Prior Publication Data

US 2021/0153661 A1 May 27, 2021

Related U.S. Application Data

(60) Provisional application No. 62/939,716, filed on Nov. 25, 2019.

(30) Foreign Application Priority Data

Aug. 7, 2020 (CN) ..... 202010790363.5
Aug. 7, 2020 (CN) ..... 202010790468.0

(51) Int. Cl.

| | |
|---|---|
| ***A47C 7/46*** | (2006.01) |
| ***A47C 7/14*** | (2006.01) |
| ***A47C 27/18*** | (2006.01) |
| ***B65F 1/06*** | (2006.01) |
| ***B65F 1/14*** | (2006.01) |
| ***A47L 15/00*** | (2006.01) |

(Continued)

(52) U.S. Cl.

CPC ..... *A47C 7/46* (2013.01); *A47L 15/0028* (2013.01); *A47L 15/16* (2013.01); *A47L 15/4285* (2013.01); *A47L 15/4295* (2013.01); *A47L 15/46* (2013.01); *B65F 1/068* (2013.01); *B65F 1/1473* (2013.01); *A47C 7/282* (2013.01); *B65F 2210/128* (2013.01); *B65F 2210/129* (2013.01); *B65F 2210/137* (2013.01); *B65F 2210/167* (2013.01); *B65F 2210/168* (2013.01); *B65F 2210/184* (2013.01)

(58) Field of Classification Search

CPC ..... A47C 7/467

See application file for complete search history.

(56) References Cited

U.S. PATENT DOCUMENTS 4,059,909 A * 11/1977 Kron ..... A47C 7/467 434/59
4,722,550 A * 2/1988 Imaoka ..... A47C 7/467 280/727

(Continued)

*Primary Examiner* — Rodney B White
(74) *Attorney, Agent, or Firm* — Li & Cai Intellectual Property (USA) Office

(57) ABSTRACT

A chair device, a mattress device, and a propping device are provided. The chair device includes a support stand, a seat module disposed above the support stand, a connection module disposed at one side of the seat module, a back support module connected to the connection module and disposed at one side of the seat module, a first pressure adjustment module disposed in the seat module, a second pressure adjustment module disposed in the back support module, a first pressure sensing module disposed in the seat module, a second pressure sensing module disposed in the back support module, and a control module. The control module adjusts the first pressure adjustment module according to first sensed pressure signals from the first pressure sensing module, and adjusts the second pressure adjustment module according to second sensed pressure signals from the second pressure sensing module.

21 Claims, 33 Drawing Sheets

(51) Int. Cl.

| | |
|---|---|
| ***A47L 15/16*** | (2006.01) |
| ***A47L 15/42*** | (2006.01) |
| ***A47L 15/46*** | (2006.01) |
| *A47C 7/28* | (2006.01) |

(56) References Cited

U.S. PATENT DOCUMENTS

| | | | | |
|---|---|---|---|---|
| 4,981,131 | A * | 1/1991 | Hazard | A47C 4/54 128/118.1 |
| 5,860,699 | A * | 1/1999 | Weeks | A47C 7/467 297/284.6 |
| 6,088,643 | A * | 7/2000 | Long | A47C 4/54 701/49 |
| 6,273,810 | B1 * | 8/2001 | Rhodes, Jr. | A47C 4/54 454/120 |
| 6,682,059 | B1 * | 1/2004 | Daniels | A47C 4/54 267/131 |
| 7,931,334 | B1 * | 4/2011 | Caruso | A47C 31/126 297/217.3 |
| 10,085,562 | B1 * | 10/2018 | Labrosse | A47C 7/727 |
| 2005/0082895 | A1 * | 4/2005 | Kimmig | A47C 27/10 297/452.41 |
| 2019/0090643 | A1 * | 3/2019 | Mason | A47C 7/142 |
| 2019/0090644 | A1 * | 3/2019 | Mason | A47C 4/28 |
| 2020/0143929 | A1 * | 5/2020 | Pathiratne | G16H 80/00 |
| 2021/0247210 | A1 * | 8/2021 | Asakawa | G01D 5/16 |

* cited by examiner

CHAIR DEVICE, PROPPING DEVICE, AND MATTRESS DEVICE

CROSS-REFERENCE TO RELATED PATENT APPLICATION

This application claims the benefit of priority to the U.S. Provisional Patent Application Ser. No. 62/939,716 filed on Nov. 25, 2019, and to China Patent Application Nos. 202010790363.5 and 202010790468.0, commonly filed on Aug. 7, 2020, in People's Republic of China. The entire content of each of the above identified applications is incorporated herein by reference.

Some references, which may include patents, patent applications and various publications, may be cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference was individually incorporated by reference.

FIELD OF THE DISCLOSURE

The present disclosure relates to a chair device, a mattress device, and a propping device, and more particularly, to a chair device, a mattress device, and a propping device that provide a comfortable experience.

BACKGROUND OF THE DISCLOSURE

For most people, chairs and mattresses are often sat or lain down upon during work. Even when resting at home, the sofa or the mattress is the first place that people turn to. Thus, apart from aesthetic considerations, the comfort level of the chair or the mattress is of major concern.

Therefore, providing a chair device or mattress device with a high level of comfort has become an important subject in the relevant field.

SUMMARY OF THE DISCLOSURE

In response to the above-referenced technical inadequacies, the present disclosure provides a chair device, a propping device, and a mattress device. The chair includes a support stand, a seat module, a connection module, a back support module, a first pressure adjustment module, a second pressure adjustment module, a first pressure sensing module, a second pressure sensing module, and a control module. The seat module is disposed above the support stand. The connection module is disposed at one side of the seat module. The back support module is connected to the connection module and disposed at one side of the seat module. The first pressure adjustment module is disposed in the seat module. The second pressure adjustment module is disposed in the back support module. The first pressure sensing module is disposed in the seat module. The second pressure sensing module is disposed in the back support module. The control module is electrically connected to the first pressure adjustment module, the second pressure adjustment module, the first pressure sensing module, and the second pressure sensing module. The control module adjusts the first pressure adjustment module according to a plurality of first sensed pressure signals from the first pressure sensing module, and adjusts the second pressure adjustment module according to a plurality of second sensed pressure signals from the second pressure sensing module.

In another aspect, the present disclosure provides a chair device. The chair device includes a support stand, a seat module, a connection module, a back support module, a first propping structure, and a second propping structure. The seat module is disposed above the support stand. The connection module is disposed at one side of the seat module. The back support module is connected to the connection module, and the back support module is disposed at one side of the seat module. The first propping structure includes a plurality of first propping modules, and the first propping structure is disposed in the seat module. Each of the first propping modules includes a first propping end and a second propping end. The first propping end of any one of the first propping modules is connected to the first propping end or the second propping end of another one of the first propping modules. The plurality of first propping modules in the first propping structure are mutually connected to form a mesh structure. The second propping structure includes a plurality of second propping modules, and the second propping structure is disposed in the back support module. Each of the second propping modules includes a first propping end and a second propping end. The first propping end of any one of the second propping module is connected to a first propping end or a second propping end of another one of the second propping module. The plurality of second propping modules in the second propping structure are mutually connected to form a mesh structure.

In yet another aspect, the present disclosure provides a propping device. The propping device includes a frame, a control module, and a plurality of propping modules. The plurality of propping modules are electrically connected to the control module. Each of the propping modules includes a first propping end and a second propping end. The first propping end of each propping module is connected to a first propping end or a second propping end of another propping module. The plurality of propping modules is mutually connected to form a mesh structure. The control module controls and adjusts a length of each of the propping modules.

In yet another aspect, the present disclosure provides a mattress device. The mattress device includes a mattress module, a control module, a pressure adjustment module, and a pressure sensing module. The pressure adjustment module includes a plurality of pressure adjustment units, and the pressure adjustment module is electrically connected to the control module. The pressure sensing module includes a plurality of pressure sensing units. Each of the pressure sensing units is disposed at one side of the corresponding pressure adjustment unit, and is electrically connected to the control module. A plurality of sensed pressure signals from the plurality of pressure sensing units of the pressure sensing module is transmitted to the control module. The control module adjusts each of the pressure adjustment units in the pressure adjustment module individually according to the plurality of sensed pressure signals from the plurality of pressure sensing units.

One of the advantageous effects of the present disclosure lies in that, the chair device of the present disclosure is provided with a first pressure adjustment module and a second pressure adjustment module that can be adjusted independently in real time, thus improving user experience. In addition, the chair device of the present disclosure can offer different adjustment manners according to different use statuses of the seat module and the back support module, so as to adjust the first pressure adjustment module and the second pressure adjustment module. Moreover, the first pressure adjustment module and the second pressure adjustment module of the present disclosure are densely arranged to provide a wrapping experience for the user.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The present disclosure will become more fully understood from the following detailed description and accompanying drawings.

DETAILED DESCRIPTION OF THE EXEMPLARY EMBODIMENTS

Figure 1:
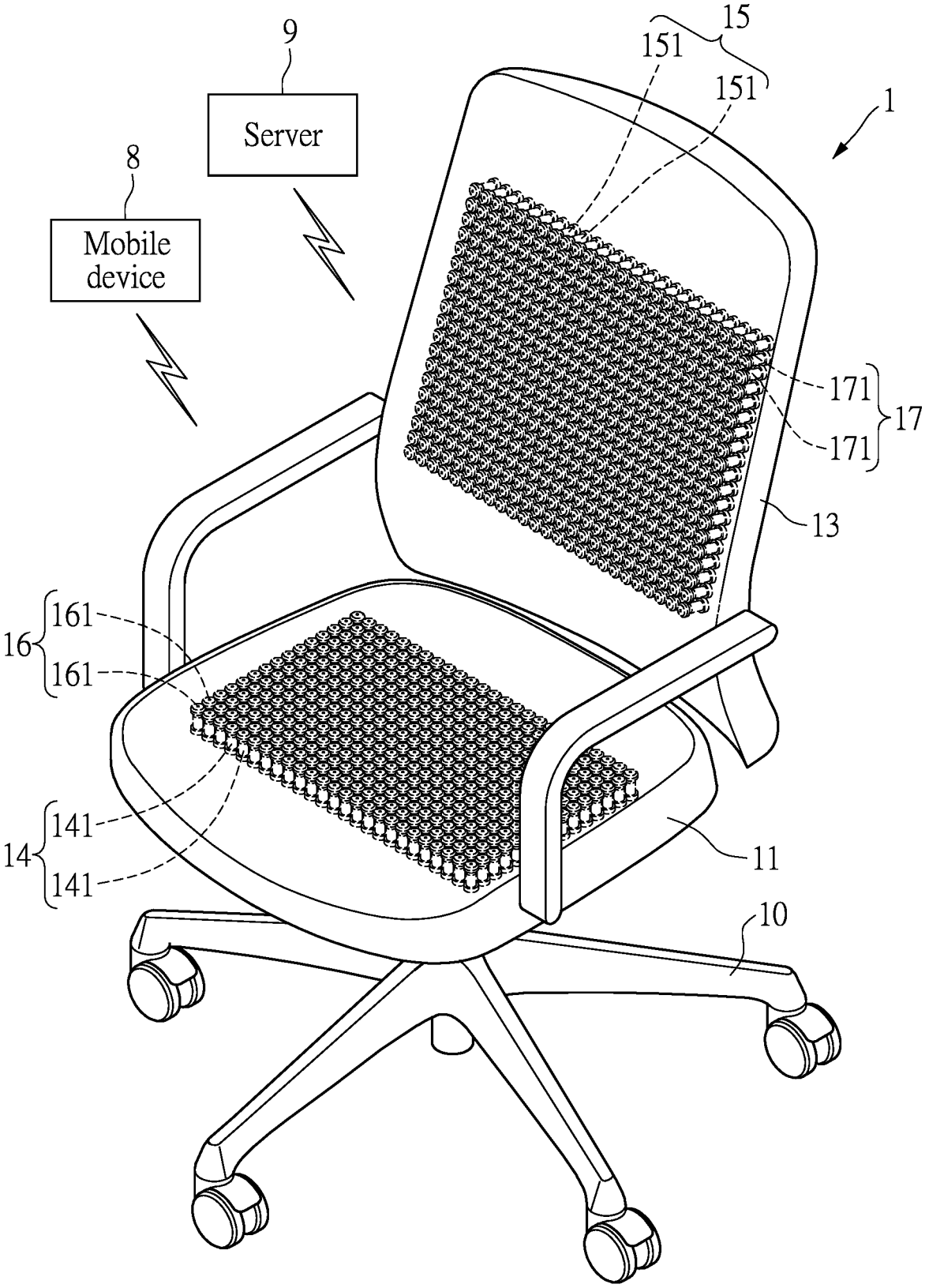
FIG. 1 is a schematic view of a chair device in an embodiment of the present disclosure.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first", "second" or "third" can be used to describe various components, signals or the like, which are for distinguishing one component/signal from another one only, and are not intended to, nor should be construed to impose any substantive limitations on the components, signals or the like.

In addition, the accompanying drawings of the present disclosure are provided merely for illustrative purposes, and are not illustrated based on actual scales. According to the actual situation, the term "or" as used herein shall include any one or multiple combinations of the associated listed items.

First Embodiment

Figure 2:
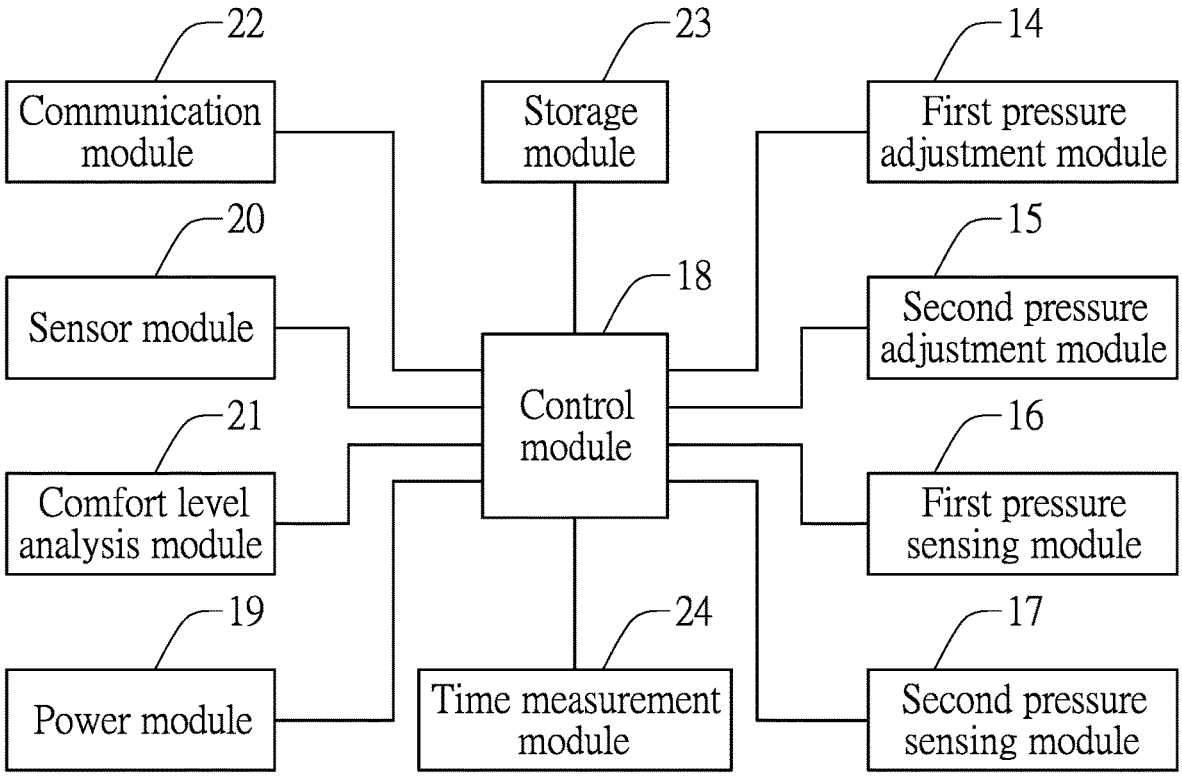
FIG. 2 is a function block diagram of the chair device in an embodiment of the present disclosure.
Figure 3:
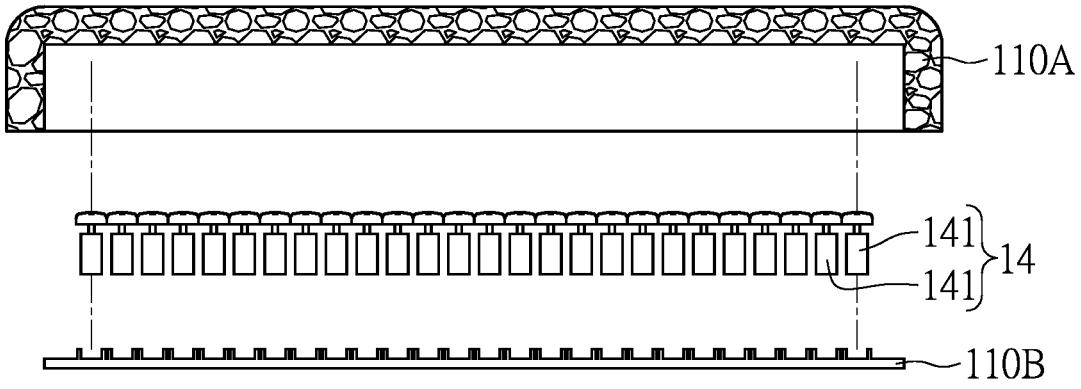
FIG. 3 is a schematic view showing that a first pressure adjustment module is disposed in a seat module according to the present disclosure.
Figure 4:
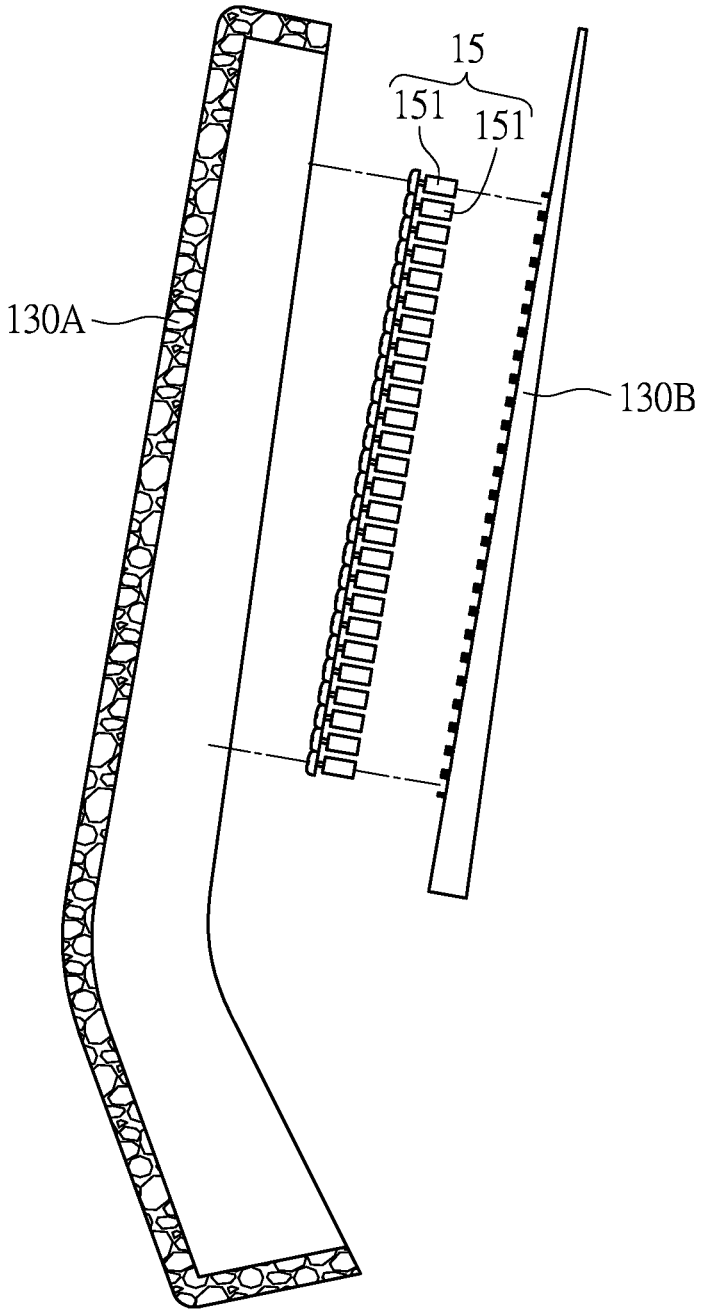
FIG. 4 is a schematic view showing that a second pressure adjustment module is disposed in a back support module according to the present disclosure.
Figure 5:
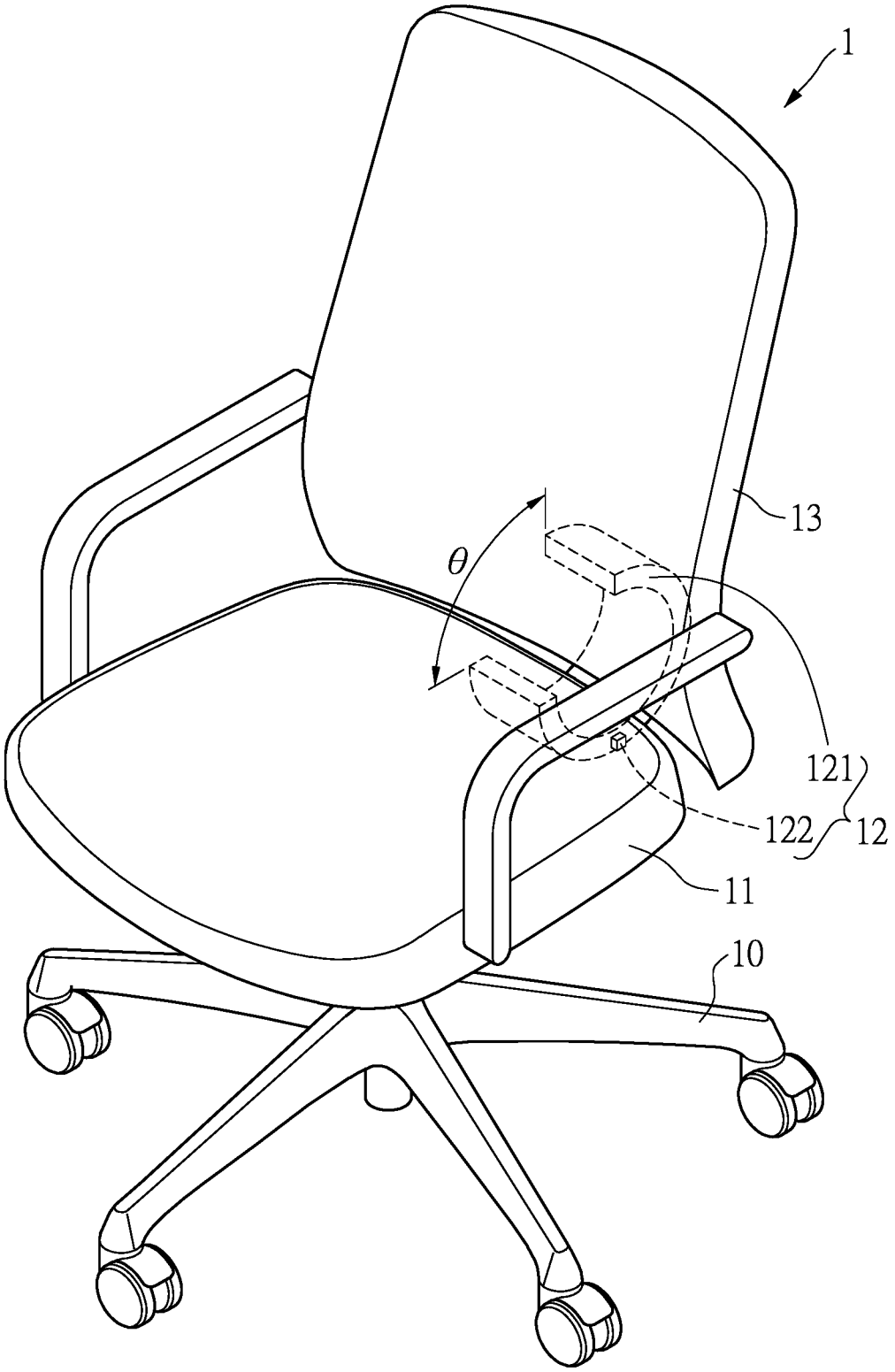
FIG. 5 is a schematic view showing that an included angle between the seat module and the back support module of the chair device is less than a predetermined angle according to the present disclosure.
Figure 6:
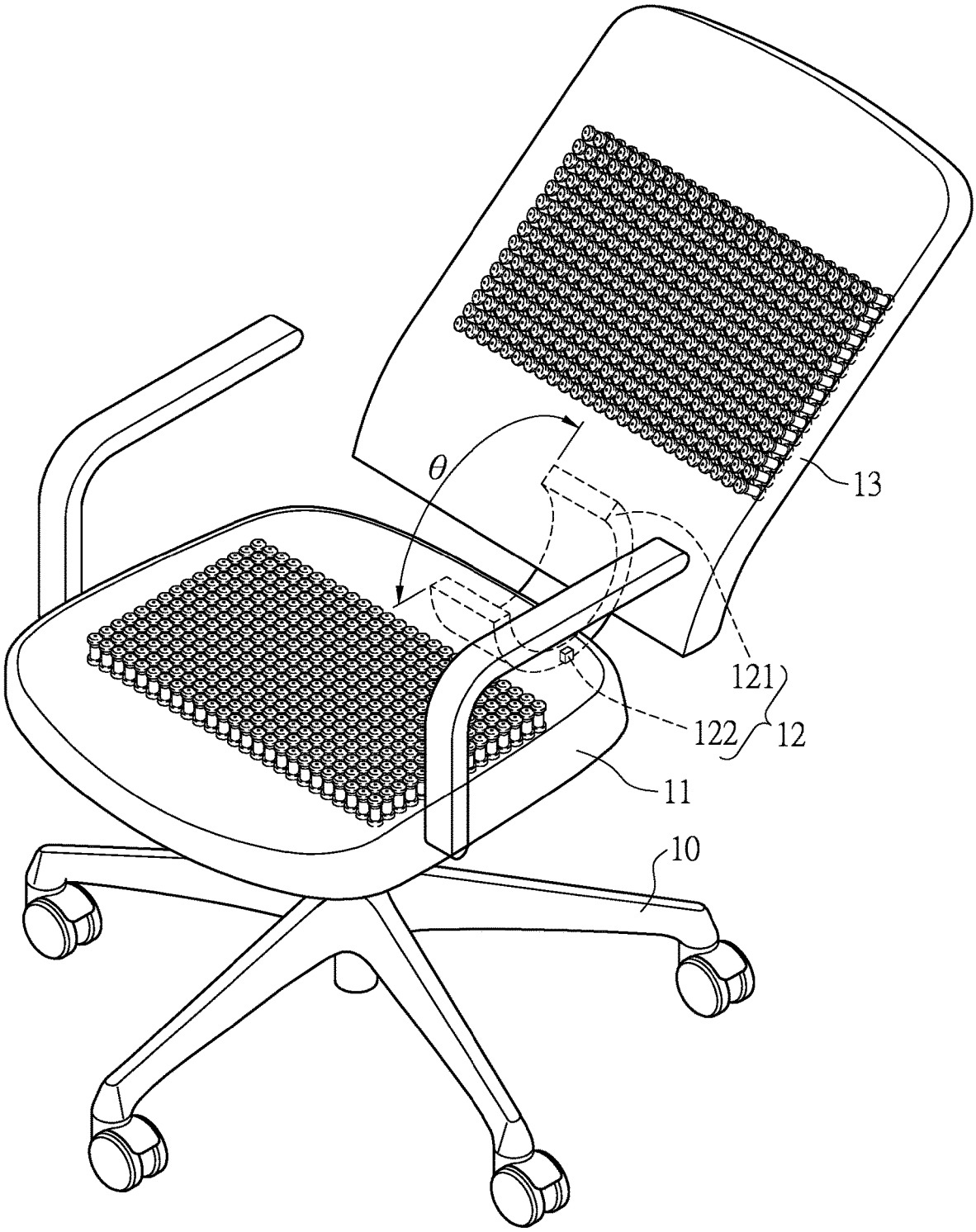
FIG. 6 is a schematic view showing that an included angle between the seat module and the back support module of the chair device is greater than a predetermined angle according to the present disclosure.

Referring to FIGS. 1, 2, 3, 4, 5, and 6, FIG. 1 is a schematic view of a chair device in an embodiment of the present disclosure. FIG. 2 is a function block diagram of the chair device in an embodiment of the present disclosure. FIG. 3 is a schematic view showing that a first pressure adjustment module is disposed in a seat module according to the present disclosure. FIG. 4 is a schematic view showing that a second pressure adjustment module is disposed in a back support module according to the present disclosure. FIG. 5 is a schematic view showing that an included angle between the seat module and the back support module of the chair device is less than a predetermined angle according to the present disclosure. FIG. 6 is a schematic view showing that an included angle between the seat module and the back support module of the chair device is greater than a predetermined angle according to the present disclosure.

The chair device 1 includes a support stand 10, a seat module 11, a connection module 12, a back support module 13, a first pressure adjustment module 14, a second pressure adjustment module 15, a first pressure sensing module 16, a second pressure sensing module 17, a control module 18, a power module 19, a sensor module 20, a comfort level analysis module 21, a communication module 22, a storage module 23, and a time measurement module 24.

The control module 18 is electrically connected to the first pressure adjustment module 14, the second pressure adjustment module 15, the first pressure sensing module 16, the second pressure sensing module 17, the power module 19, the sensor module 20, the comfort level analysis module 21, the communication module 22, the storage module 23, and the time measurement module 24. The control module 18 is a central processing unit (CPU), an application-specific integrated circuit (ASIC), or a microprocessor control unit (MCU).

Referring to FIGS. 5 and 6, the support stand 10 includes a plurality of support columns which are in contact with the ground, and the seat module 11 is disposed above the support stand 10. The connection module 12 is disposed between the seat module 11 and the back support module 13. That is, the back support module 13 is disposed at one side of the seat module 11 via the connection module 12. An included angle θ ranging from 90° to 180° is formed between the seat module 11 and the back support module 13.

The connection module 12 includes a hinge unit 121 and an angular sensor 122. The hinge unit 121 is disposed between the seat module 11 and the back support module 13, and the angular sensor 122 is disposed on one side of the hinge unit 121 to detect the included angle θ between the seat module 11 and the back support module 13. The angular sensor 122 is electrically connected to the control module 18.

Referring to FIGS. 3 and 4, in this embodiment, the first pressure adjustment module 14 and the first pressure sensing module 16 are disposed in the seat module 11. The second pressure adjustment module 15 and the second pressure sensing module 17 are disposed in the back support module 13. The seat module 11 includes a comfortable seat material layer 110A and a seat propping material layer 110B, and the back support module 13 includes a comfortable back-support material layer 130A and a back support propping material layer 130B. The first pressure adjustment module 14 and the first pressure sensing module 16 are disposed between the comfortable seat material layer 110A and the seat propping material layer 110B, and the second pressure adjustment module 15 and the second pressure sensing module 17 are disposed between the comfortable back-support material layer 130A and the back support propping material layer 130B. The comfortable seat material layer 110A and the comfortable back-support material layer 130A may be made from fabric or foam, and the seat propping material layer 110B and the back support propping material layer 130B may be made from wood, plastic, or metal.

In this embodiment, the control module 18 adjusts the first pressure adjustment module 14 according to a plurality of first sensed pressure signals from the first pressure sensing module 16, and adjusts the second pressure adjustment module 15 according to a plurality of second sensed pressure signals from the second pressure sensing module 17. That is, when an included angle between the seat module 11 and the back support module 13 of the chair device 1 is less than a predetermined angle, the control module 18 adjusts the first pressure adjustment module 14 in the seat module 11 and the second pressure adjustment module 15 in the back support module 13 separately. The control module 18 may adjust only the first pressure adjustment module 14 in the seat module 11. Especially, when a user leans forward, his/her weight is applied only on the seat module 11, and the user does not lean against or just lightly leans against the back support module 13. In this case, the control module 18 mainly adjusts the first pressure adjustment module 25 in the seat module 11, so as to improve the user experience. The predetermined angle may be 100° or 110°, and set by the user personally. In this embodiment, the connection module 12 may be adjusted in terms of angle by using a gear adjustment assembly, an air pressure adjustment assembly, or a hydraulic adjustment assembly via first pressure adjustment units 141 of the first pressure adjustment module 14 that are close to the connection module 12 or second pressure adjustment units 151 of the second pressure adjustment module 15 that are close to the connection module 12. That is, the angle between the seat module 11 and the back support module 13 may be adjusted via the first pressure adjustment module 14 and the second pressure adjustment module 15.

Figure 7:
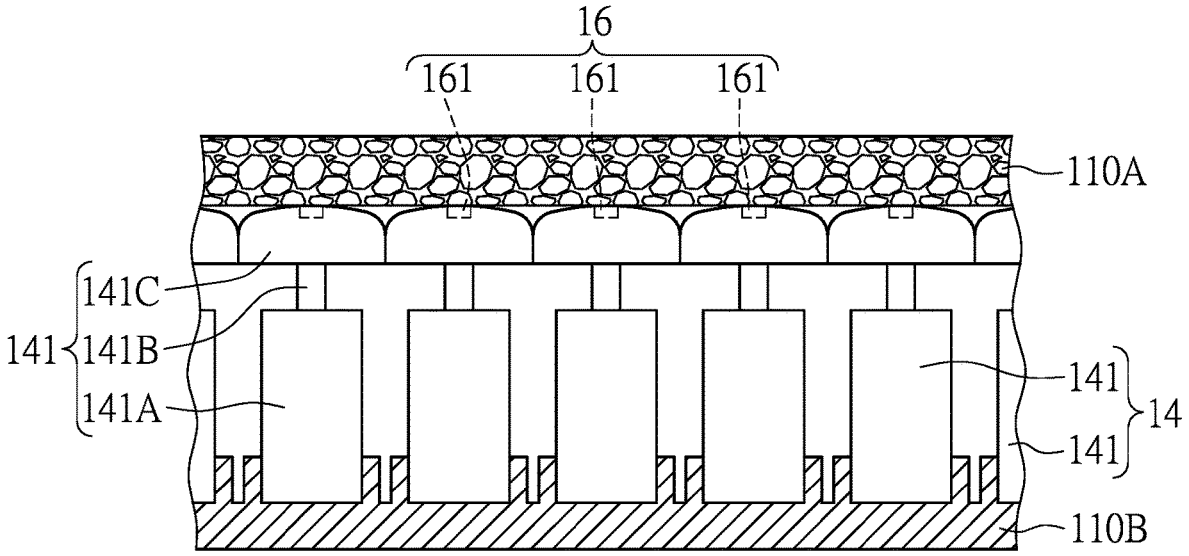
FIG. 7 is a schematic view of the first pressure adjustment module according to the present disclosure.
Figure 8:
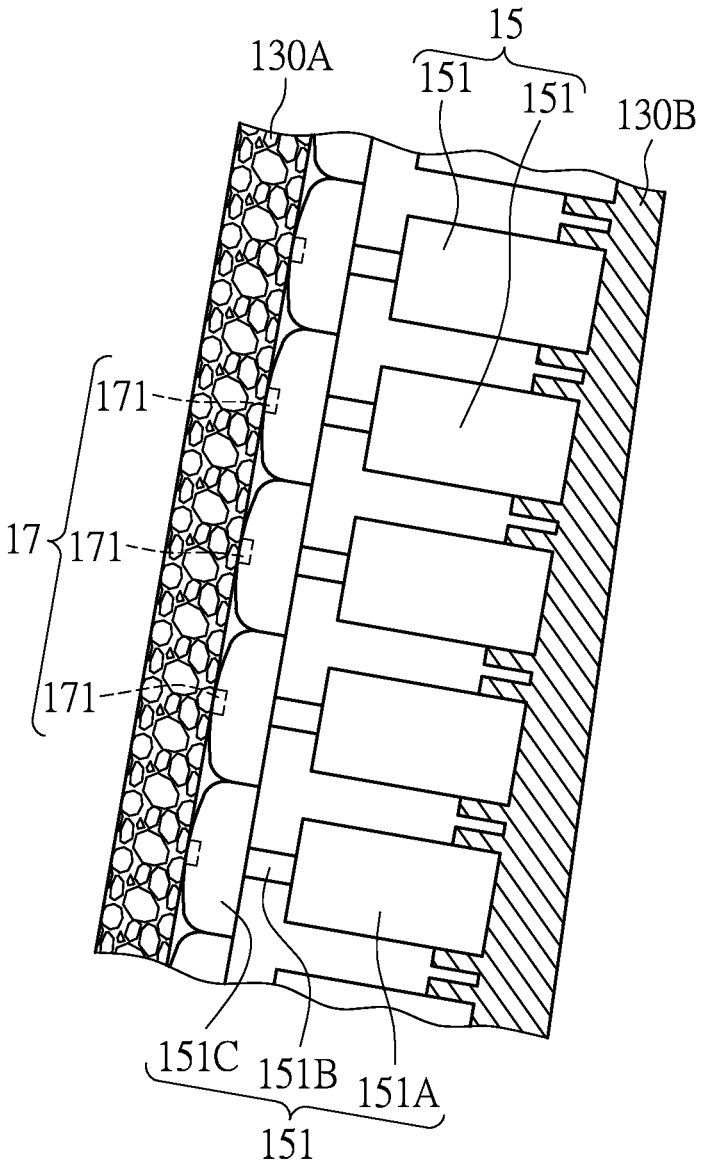
FIG. 8 is a schematic view of the second pressure adjustment module according to the present disclosure.
Figure 9:
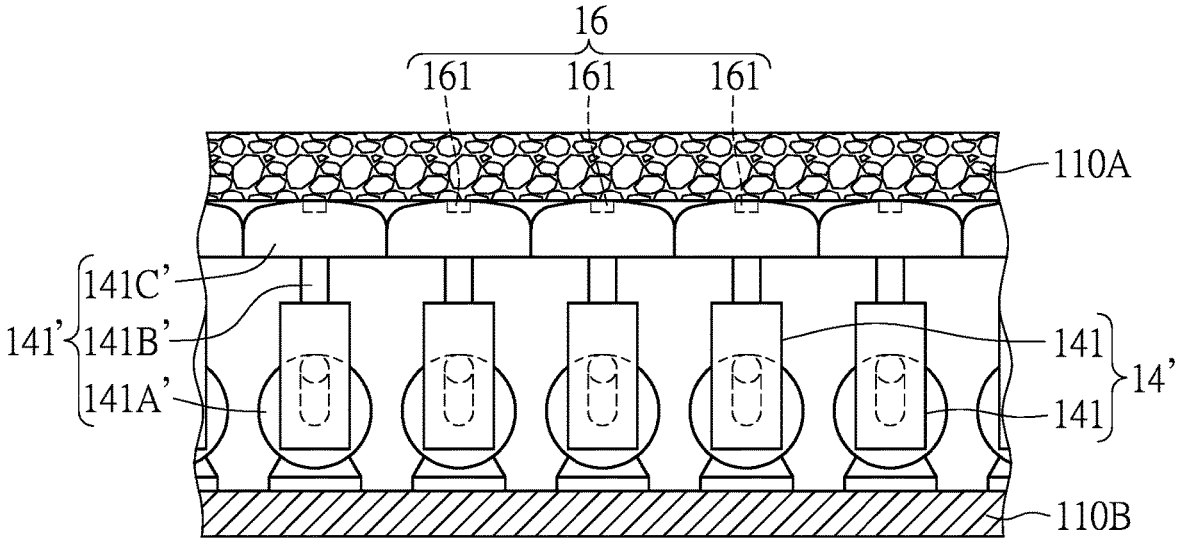
FIG. 9 is another schematic view of the first pressure adjustment module according to the present disclosure.
Figure 10:
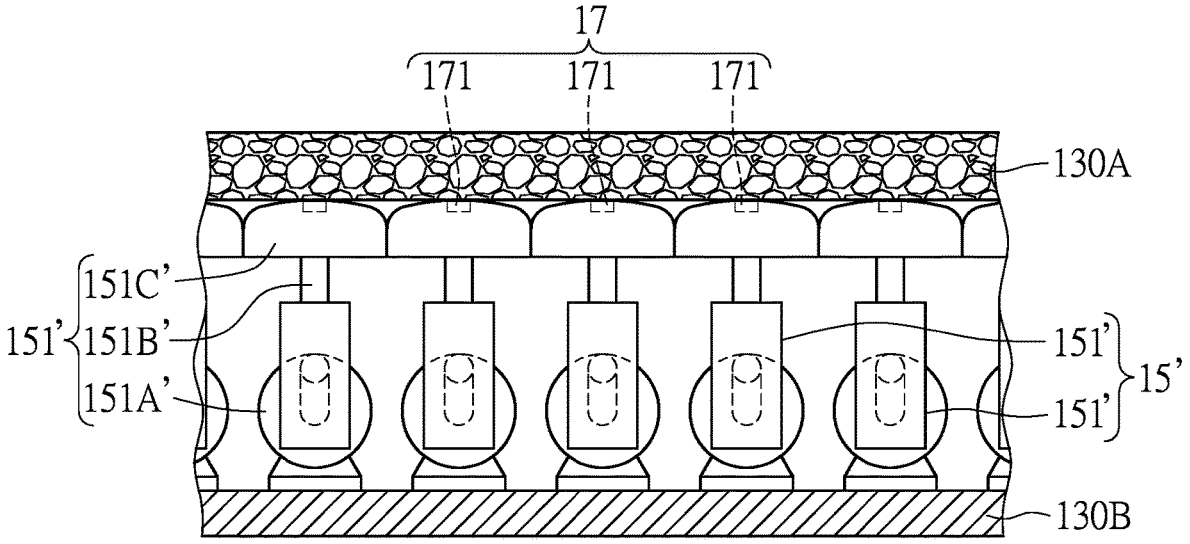
FIG. 10 is another schematic view of the second pressure adjustment module according to the present disclosure.
Figure 11:
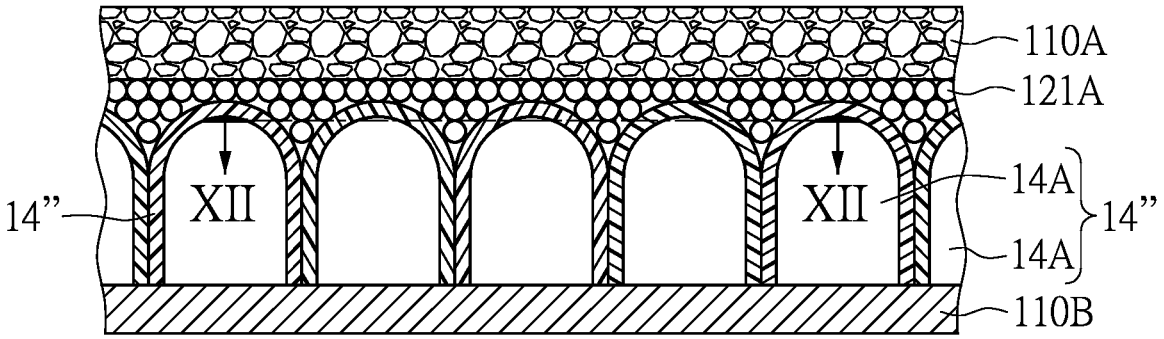
FIG. 11 is still another schematic view of the first pressure adjustment module according to the present disclosure.
Figure 12:
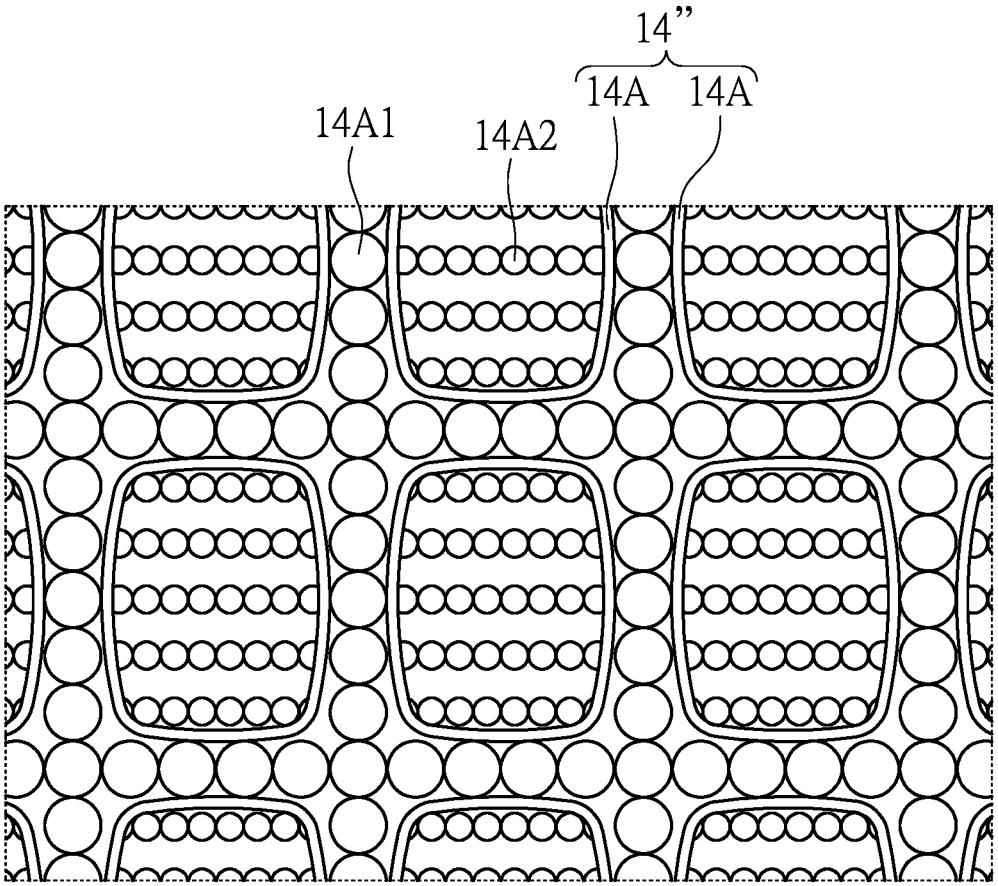
FIG. 12 is a schematic view of first spherical objects and second spherical objects in the first pressure adjustment module taken along a section line XII-XII in FIG. 11.

Referring to FIGS. 7, 8, 9, 10, 11, and 12, FIG. 7 is a schematic view of the first pressure adjustment module according to the present disclosure. FIG. 8 is a schematic view of the second pressure adjustment module according to the present disclosure. FIG. 9 is another schematic view of the first pressure adjustment module according to the present disclosure. FIG. 10 is another schematic view of the second pressure adjustment module according to the present disclosure. FIG. 11 is still another schematic view of the first pressure adjustment module according to the present disclosure. FIG. 12 is a schematic view of first spherical objects and second spherical objects in the first pressure adjustment module presented along a section line XII-XII in FIG. 11.

The first pressure adjustment module 14 includes the plurality of first pressure adjustment units 141, and the second pressure adjustment module 15 includes the plurality of second pressure adjustment units 151. The first pressure sensing module 16 includes a plurality of first pressure sensing units 161, and the second pressure sensing module 17 includes a plurality of second pressure sensing units 171.

The control module 18 can adjust the plurality of first pressure adjustment units 141 of the first pressure adjustment module 14 according to a plurality of first sensed pressure signals from the plurality of first pressure sensing units 161 of the first pressure sensing module 16, and can also adjust the plurality of second pressure adjustment units 151 of the second pressure adjustment module 15 according to a plurality of second sensed pressure signals from the plurality of second pressure sensing units 171 of the second pressure sensing module 17.

Likewise, when the included angle between the seat module 11 and the back support module 13 of the chair device 1 is less than a predetermined angle, the control module 18 adjusts the plurality of first pressure adjustment units 141 of the first pressure adjustment module 14 in the seat module 11 and the plurality of second pressure adjustment units 151 of the second pressure adjustment module 15 in the back support module 13 separately. In this case, the control module 18 mainly adjusts the plurality of first pressure adjustment units 141 of the first pressure adjustment module 14 in the seat module 11, so as to improve user experience.

Moreover, a time measurement module 24 of the chair device 1 is a timer, and is electrically connected to the control module 18. After receiving the plurality of first sensed pressure signals from the first pressure sensing module 16 and the plurality of second sensed pressure signals from the second pressure sensing module 17 for a predetermined period of time, the control module 18 provides a plurality of pressure adjustment signals to the plurality of first pressure adjustment units 141 of the first pressure adjustment module 14 and the plurality of second pressure adjustment units 151 of the second pressure adjustment module 15, so as to adjust pressure values provided by the plurality of first pressure adjustment units 141 and the plurality of second pressure adjustment units 151 onto the seat module 11 and the back support module 13, respectively. The predetermined time may be 5 or 10 minutes, and be set by the user personally.

When the included angle θ is greater than the predetermined angle, the control module 18 simultaneously controls the plurality of first pressure adjustment units 141 of the first pressure adjustment module 14 and the plurality of second pressure adjustment units 151 of the second pressure adjustment module 15. That is, when the included angle θ is greater than the predetermined angle, the control module 18 determines that the chair device 1 is presently in a chair device status, and the user on the chair device 1 at this time should be lying on the chair device 1. Therefore, the control module 18 simultaneously controls the plurality of first pressure adjustment units 141 of the first pressure adjustment module 14 and the plurality of second pressure adjustment units 151 of the second pressure adjustment module 15, so that the chair device 1 in this case has a pressure adjustment function and can be adjusted in terms of pressure. In this case, the control module 18 may specifically adjust the pressure of the multiple adjacent first pressure adjustment units 141 and second pressure adjustment units 151 (corresponding to the user's waist and back), so as to enhance the support for the user's waist and back and to further improve user experience.

Referring to FIGS. 7 and 8, in this embodiment, each first pressure adjustment unit 141 includes a micro motor 141A, a connection unit 141B, and an elastic unit 141C. The connection unit 141B is connected onto the micro motor 141A, and the elastic unit 141C is disposed on the connection unit 141B. In this embodiment, the micro motor 141A is vertically connected to the elastic unit 141C, and implements a back-and-forth movement stroke. That is, when the first pressure adjustment unit 141 is vertically disposed, the micro motor 141A can be vertically adjusted to different heights.

Similarly, each second pressure adjustment unit 151 includes a micro motor 151A, a connection unit 151B, and an elastic unit 151C. The connection unit 151B is connected onto the micro motor 151A, and the elastic unit 151C is disposed on the connection unit 151B. In this embodiment, the micro motor 151A is vertically connected to the elastic unit 151C, and implements a back-and-forth movement stroke. That is, when the second pressure adjustment unit 151 is vertically disposed, the micro motor 151A can be vertically adjusted to different heights.

Referring to FIGS. 9 and 10, in this embodiment, each first pressure adjustment unit 141' includes a micro motor 141A', a connection unit 141B', and an elastic unit 141C'. The connection unit 141B' is connected onto the micro motor 141A', and the elastic unit 141C' is disposed on the connection unit 141B'. In this embodiment, the micro motor 141A' is horizontally linked to the elastic unit 141C', and a central axis of the micro motor 141A' is connected to the connection unit 141B'. These micro motors 141A' are small in size and are densely arranged, and can therefore provide a better lying experience. Especially, since the micro motors 141A and 141A' in the present disclosure are densely arranged and capable of being adjusted in real time, the micro motors 141A and 141A' can provide a user who lies down to have a wrapping feeling and a comfortable lying experience.

In this embodiment, each second pressure adjustment unit 151' includes a micro motor 151A', a connection unit 151B', and an elastic unit 151C'. The connection unit 151B' is connected onto the micro motor 151A', and the elastic unit 151C' is disposed on the connection unit 151B'. In this embodiment, the micro motor 151A' is horizontally linked to the elastic unit 151C', and a central axis of the micro motor 151A' is connected to the connection unit 151B'. These micro motors 151A' are small in size and are densely arranged, and can therefore provide a better lying experience. Especially, since the micro motors 151A and 151A' in the present disclosure are densely arranged and capable of being adjusted in real time, the micro motors 151A and 151A' can provide a user who lies down to have a wrapping feeling and a comfortable lying experience.

In this embodiment, the elastic units 141C, 151C, 141C' and 151C' may be made from rubber or foam, the connection units 141B and 151B are metal sleeves, and the connection units 141B' and 151B' separately include an eccentric wheel and a linked metal arm.

Referring to FIG. 11, in this embodiment, the first pressure adjustment module 14" includes a plurality of airbag units 14A and a pump (not shown in the figure). The plurality of airbag units 14A are connected to the pump, and the pump (not shown in the figure) is used to inflate or deflate the airbag units 14A separately, so as to implement pressure adjustment. Similar to the arrangement in the foregoing embodiment, the comfortable seat material layer 110A is also disposed on the plurality of airbag units 14A of the first pressure adjustment module 14". Similarly, each airbag unit 14A may be inflated or deflated individually, so as to implement pressure adjustment. These airbag units 14A are each designed into a small-sized airbag, and are densely arranged, thus providing a better lying experience.

In this embodiment, a second pressure adjustment module 15" includes a plurality of airbag units 15A and a pump (not shown in the figure). The plurality of airbag units 15A are connected to the pump, and the pump (not shown in the figure) is used to inflate or deflate the airbag units 15A separately, so as to implement pressure adjustment. Similar to the arrangement in the foregoing embodiment, the comfortable back-support material layer 130A is also disposed on the plurality of airbag units 15A of the second pressure adjustment module 15". Similarly, each airbag unit 15A may be inflated or deflated individually, so as to implement pressure adjustment. These airbag units 15A are each designed into a small-sized airbag, and are densely arranged, thus providing a better lying experience.

Referring to FIG. 12, description is made below by using the first pressure adjustment module 14" as an example. The status of the second pressure adjustment module 15" is similar to that of the first pressure adjustment module 14", and will not be reiterated herein. FIG. 12 is a schematic view showing that a plurality of spherical objects is disposed on the plurality of airbag units 14A of the pressure adjustment module 14".

This embodiment involves two types of spherical objects, one of which being a big first spherical object 14A1 and the other one being a small second spherical object 14A2. The big first spherical objects 14A1 are disposed in gaps between the airbag units 14A, and the small second spherical objects 14A2 are disposed on the surfaces of the airbag units 14A. The first spherical objects 14A1 and the second spherical objects 14A2 are both connected in series via a steel wire or plastic wire, so that the first spherical objects 14A1 and the second spherical objects 14A2 can be disposed on the pressure adjustment module 14". The first spherical objects 14A1 and the second spherical objects 14A2 are steel beads, ceramic beads, plastic beads, or the like, and are in contact with the comfortable seat material layer 110A in a point contact mode.

As shown in FIG. 12, the first spherical objects 14A1 and the second spherical objects 14A2 in this embodiment are both arranged in a matrix, and may be arranged in the shape of a triangle, quadrangle, hexagon, or polygon in other embodiments.

In this embodiment, the sensor module 20 is mainly used to detect first environmental parameters of the seat module 11 or second environmental parameters of the seat module 11 and the back support module 13.

When the included angle θ between the seat module 11 and the back support module 13 is less than the predetermined angle, the sensor module 20 detects the first environmental parameters of the seat module 11.

When the included angle θ between the seat module 11 and the back support module 13 is greater than the predetermined angle, the sensor module 20 detects the second environmental parameters of the seat module 11 and the back support module 13.

The sensor module 20 includes at least a gyro sensor or a vibration sensor. Mattress environmental parameters include at least a vibration status of a mattress module 10.

In addition, the sensor module 20 further includes a temperature sensor or a humidity sensor used to detect the temperature or humidity of the surface of the mattress module.

The sensor module 20 may further include an image sensor, an infrared sensor, a laser ranging sensor, an optical sensor, an olfactory gas sensor, or a weight sensor.

The comfort level analysis module 21 receives the first environmental parameters, the second environmental parameters, the plurality of first sensed pressure signals, and the plurality of second sensed pressure signals from the sensor module 20, so as to determine a comfort level parameter when a user sits in the chair device 1. In this embodiment, the comfort level analysis module 21 uses software for analysis, and may also use hardware or firmware in other embodiments.

In other embodiments, the chair device 1 may also use an optical sensor (not shown in the figure) of the sensor module 20 to detect the comfort level parameter of the user. When the user sits comfortably, his/her body movements are more stable, and there will be fewer movements. Therefore, based on such a feature, the designer may use the vibration sensor, gyro sensor, or optical sensor to detect whether there is constant movement of the user's body when being in the chair device 1, so as to further determine the comfort level parameter when the user sits in the chair device 1.

That is, when the included angle θ between the seat module 11 and the back support module 13 is less than a predetermined angle, the plurality of first pressure sensing units 161 of the first pressure sensing module 16 in the seat module 11 detect a pressure value which is applied by the user on the comfortable seat material layer 110A of the seat module 11, and transmit sensed pressure signals obtained after detection to the control module 18. The control module 18 then transmits these first sensed pressure signals to the comfort level analysis module 21. In addition, the first environmental parameters detected by the sensor module 20 are also transmitted to the comfort level analysis module 21 for analysis.

The comfort level analysis module 21 first makes analysis according to the first environmental parameters. When a vibration status in the first environmental parameters is greater than a first vibration default value, it is determined that the comfort level is low. Further, the comfort level analysis module 21 analyzes the plurality of first sensed pressure signals, and searches for a region that has a high pressure value. When a maximum pressure value of a region is greater than N times of a surrounding pressure value, the comfort level analysis module 21 provides a low-comfort pressure adjustment signal to the control module 18, so that the control module 18 adjusts corresponding pressure adjustment units 121 of the pressure adjustment module 12 to reduce a pressure difference value of a region that has a large pressure difference. N is greater than or equal to 1, and is a rational number. That is, the control module 18 adjusts the region that has a large pressure difference in the sensed pressure signals according to the low-comfort pressure adjustment signal. Afterwards, the comfort level analysis module may continuously monitor a lying status of the user according to the mattress environmental parameters.

That is, when the included angle θ between the seat module 11 and the back support module 13 is greater than the predetermined angle, the user should be in the chair device 1 in a lying down position in this case. The plurality of first pressure sensing units 161 of the first pressure sensing module 16 in the seat module 11 detects a pressure value which is applied by the user on the comfortable back-support material layer 110A of the back support module 13, and transmits sensed pressure signals obtained after detection to the control module 18. The plurality of second pressure sensing units 171 of the second pressure sensing module 17 in the back support module 13 detects a pressure value which is applied by the user on the comfortable back-support material layer 130A of the back support module 13, and transmits second sensed pressure signals obtained after detection to the control module 18.

The control module 18 transmits these first sensed pressure signals and second sensed pressure signals to the comfort level analysis module 21. In addition, the second environmental parameters detected by the sensor module 20 are also transmitted to the comfort level analysis module 21 for analysis.

The comfort level analysis module 21 first makes analysis according to the first environmental parameters. When a vibration status in the first environmental parameters is greater than a first vibration default value, it is determined that the comfort level is low. Further, the comfort level analysis module 21 analyzes the plurality of first sensed pressure signals, and searches for a region that has a high pressure value. When a maximum pressure value of a region is greater than N times of a surrounding pressure value, the comfort level analysis module 21 provides a low-comfort pressure adjustment signal to the control module 18, so that the control module 18 adjusts corresponding pressure adjustment units 121 of the pressure adjustment module 12 to reduce a pressure difference value of a region that has a large pressure difference. N is greater than or equal to 1 and is a rational number. That is, the control module 18 adjusts the region that has a large pressure difference in the sensed pressure signals according to the low-comfort pressure adjustment signal. Afterwards, the comfort level analysis module may continuously monitor a lying status of the user according to the mattress environmental parameters.

The chair device 1 may be communicatively connected to a server 9 or a mobile device 8 via a communication module 22. The user may be communicatively connected to the communication module 22 in the chair device 1 via an application program (APP) in the mobile device 9, so as to send a pressure adjustment signal for pressure adjustment.

In this embodiment, the communication module 22 includes a wired communication unit (not shown in the figure) and a wireless communication unit (not shown in the figure). The wired communication unit (not shown in the figure) may also be independently disposed so as to establish a communicative connection with the server 9, and to receive a control signal from the server 9 or data in a database (not shown in the figure).

The wireless communication unit (not shown in the figure) may be a WI-FI® communication unit, a BLUETOOTH® communication unit, a ZIGBEE® communication unit, a LoRa communication unit, a Sigfox communication unit, or an NB-IoT communication unit.

The storage module 23 is used to store various parameters of the chair device 1. The storage module 23 is a flash memory, a read-only memory, a programmable read-only memory, an electrically rewritable read-only memory, an erasable programmable read-only memory, or an electrically-erasable programmable read-only memory.

Figure 13:
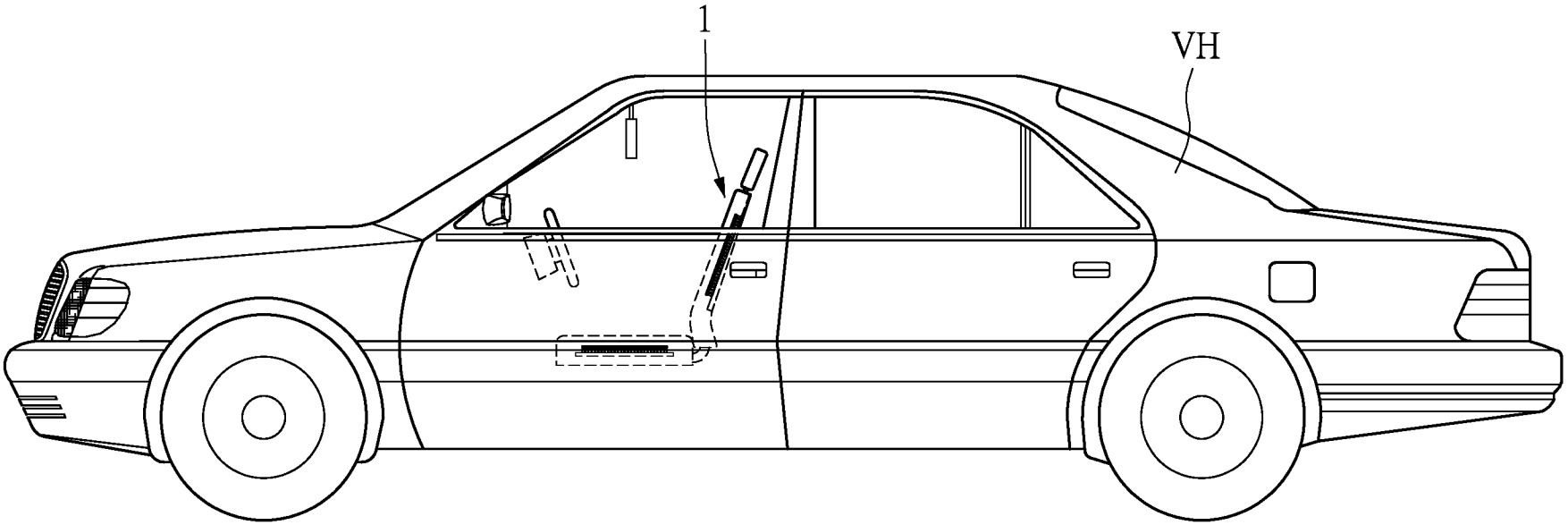
FIG. 13 is a schematic view showing the chair device being mounted in a movable carrier according to the present disclosure.

Referring to FIG. 13, FIG. 13 is a schematic view showing that the chair device is mounted in a movable carrier according to the present disclosure.

When the chair device 1 of the present disclosure is mounted in a movable carrier VH, the first pressure adjustment module 14 in the seat module 11 and the second pressure adjustment module 15 in the back support module 13 of the chair device 1 are continuously on standby.

When the movable carrier VH receives an impact, the control module 18 may adjust and control the first pressure adjustment module 14 and the second pressure adjustment module 15 to disperse the impact force. The micro motors in FIGS. 7 to 10 retract the stroke to the minimum, that is, retract towards the seat propping material layer 110B and the back support propping material layer 130B. In this way, the impact force on the user can be dispersed through the plurality of first pressure adjustment units 141 and the plurality of second pressure adjustment units 151, so as to reduce an impact injury to the user's body. The movable carrier VH may be a car, a van, a sports car, a truck, a bus, a train, or an airplane.

Second Embodiment

Figure 14:
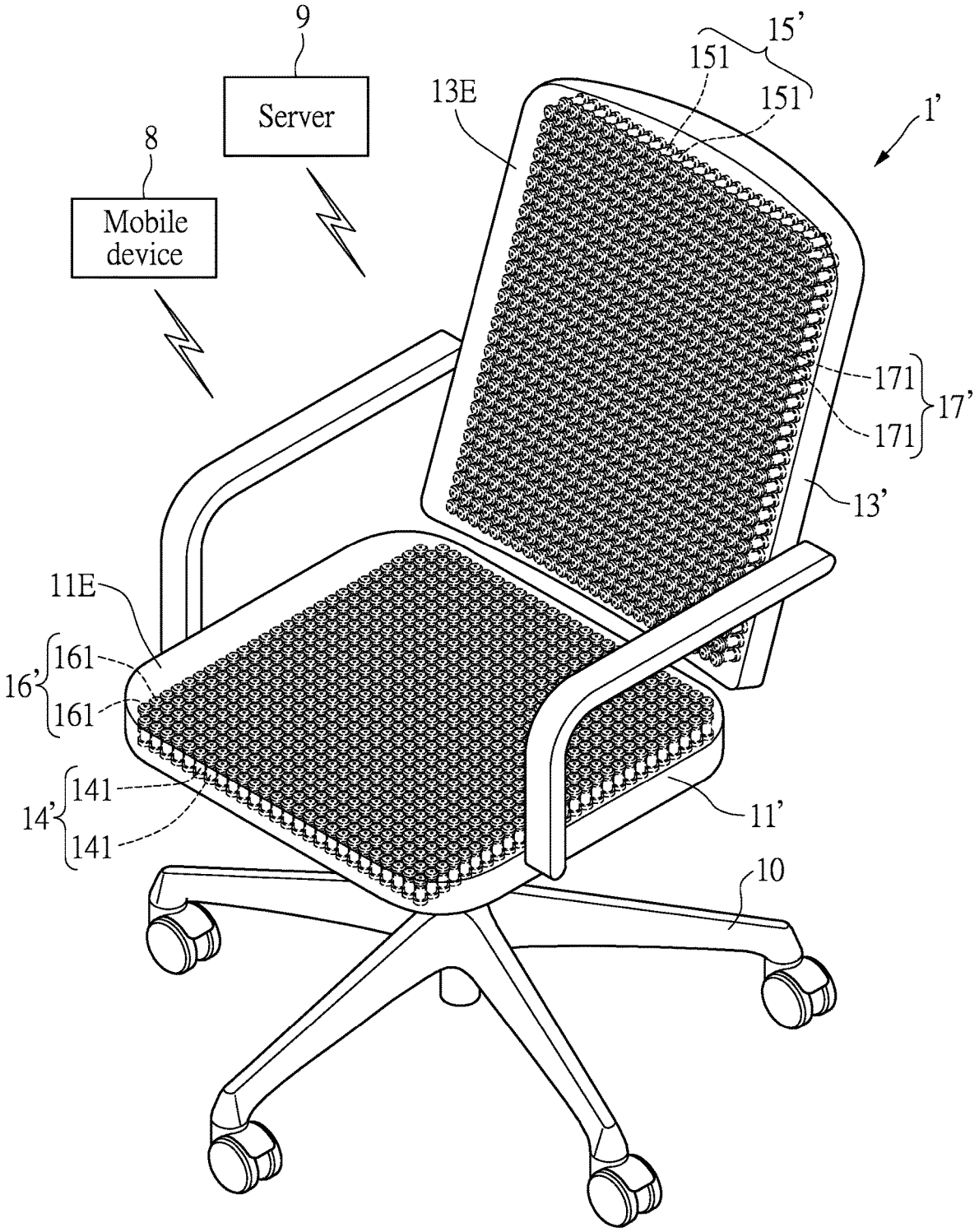
FIG. 14 is another schematic view of a chair device in a second embodiment of the present disclosure.
Figure 15:
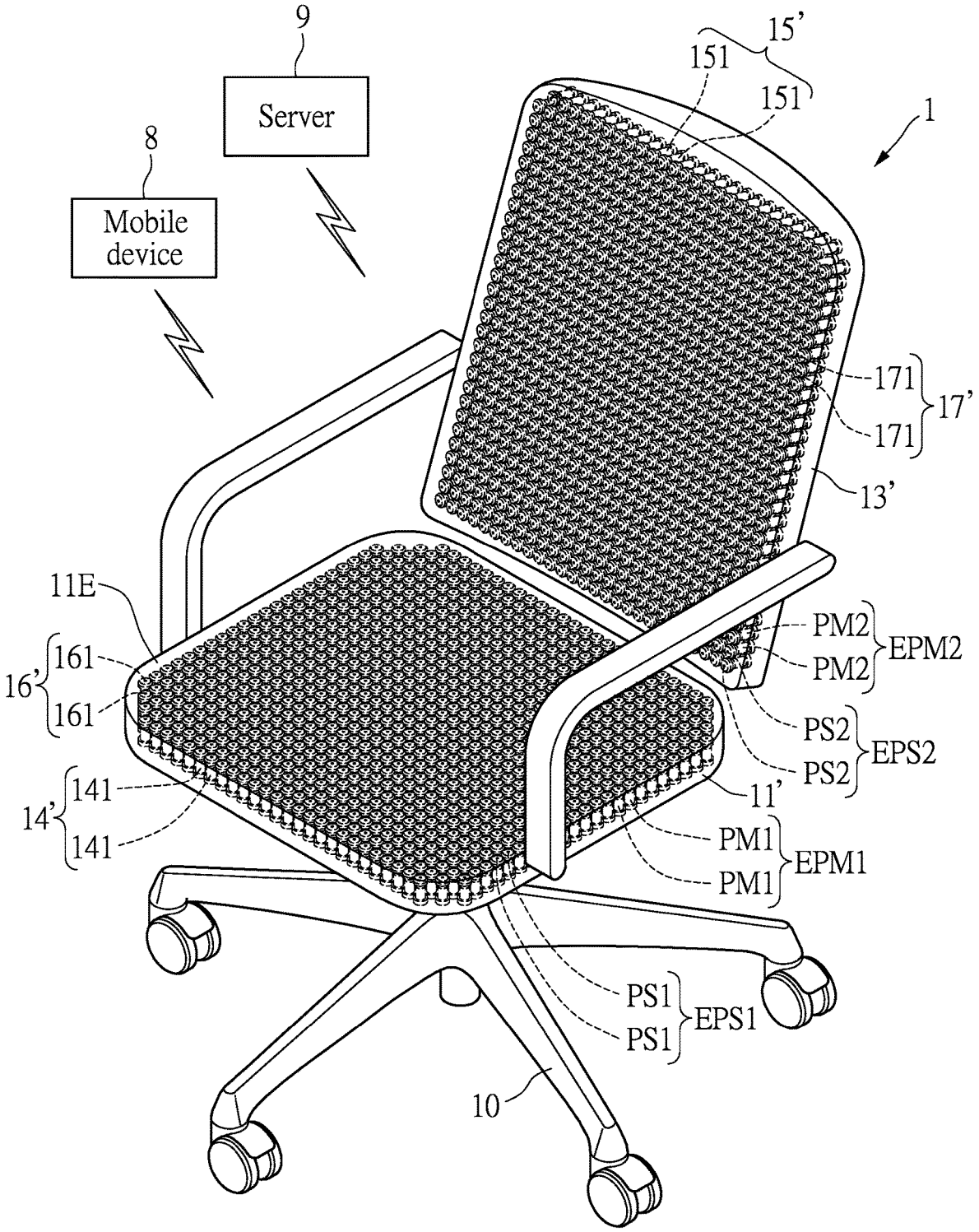
FIG. 15 is still another schematic view of the chair device in the second embodiment of the present disclosure.
Figure 16:
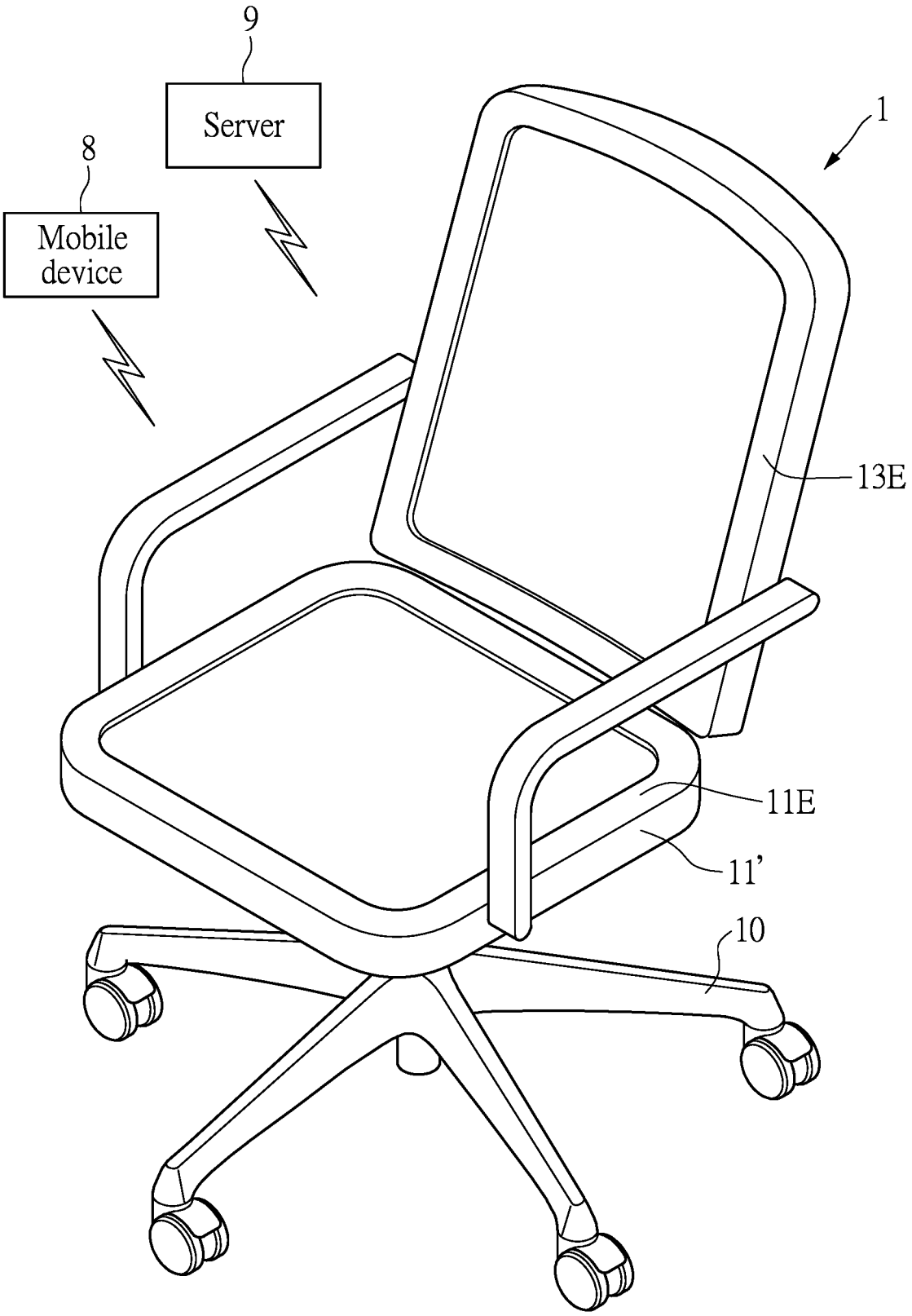
FIG. 16 is a schematic view showing respective edge regions of a seat module and a back support module being higher than respective central regions in the second embodiment of the present disclosure.

Referring to FIGS. 14, 15, and 16, FIG. 14 is another schematic view of a chair device in a second embodiment of the present disclosure. FIG. 15 is still another schematic view of the chair device in the second embodiment of the present disclosure. FIG. 16 is a schematic view showing that respective edge regions of a seat module and a back support module are higher than respective central regions in the second embodiment of the present disclosure.

Referring to FIG. 14, in a chair device 1', a seat module 11' has a first pressure adjustment module 14' and a first pressure sensing module 17' disposed in the central region, and a back support module 13' has a second pressure adjustment module 15' and a second pressure sensing module 17' disposed in the central region. In this embodiment, the first pressure adjustment module 14' and the second pressure adjustment module 15' are arranged to be adjacent. There is no empty region between the first pressure adjustment module 14' and the second pressure adjustment module 15'.

Referring to FIG. 15, moreover, an edge region 11E of the seat module 11' has a first edge pressure adjustment module EPM1 disposed therein, and an edge region 13E of the back support module 13' has a second edge pressure adjustment module EPM2 disposed therein. The first edge pressure adjustment module EPM1 and the second edge pressure adjustment module EPM2 are respectively fitted with a first edge pressure sensing module EPS1 and a second edge pressure sensing module EPS2.

The first edge pressure adjustment module EPM1 includes a plurality of first edge pressure adjustment units PM1, and the second edge pressure adjustment module EPM2 includes a plurality of second edge pressure adjustment units PM2. The first edge pressure adjustment units PM1, the second edge pressure adjustment units PM2, and pressure adjustment units 141 all include a micro motor.

Likewise, the first edge pressure sensing module EPS1 includes a plurality of first edge pressure sensing units PS1 each disposed at one side of the corresponding first edge pressure adjustment unit PM1.

The second edge pressure sensing module EPS2 includes a plurality of second edge pressure sensing units PS2 each disposed at one side of the corresponding second edge pressure adjustment unit PM2.

That is, the first edge pressure sensing units PS1 collocate with the first edge pressure adjustment units PM1 in a one-to-one correspondence manner, and the second edge pressure sensing units PS2 also collocate with the second edge pressure adjustment units PM2 in a one-to-one correspondence manner.

In this embodiment, one to three rows of the first edge pressure adjustment units PM1 may be arranged in the first edge region 11E, so as to improve the lying comfort. One to three rows of the second edge pressure adjustment units PM2 may be arranged in the second edge region 15E, so as to improve the lying comfort. In other embodiments, the numbers of the first edge pressure adjustment units PM1 and the second edge pressure adjustment units PM2 may be adjusted according to practical requirement.

Each first edge pressure adjustment unit PM1 includes a first micro motor (not shown in the figure), a first retractable unit (not shown in the figure), and a first elastic unit (not shown in the figure). Each second edge pressure adjustment unit PM2 includes a second micro motor (not shown in the figure), a second retractable unit (not shown in the figure), and a second elastic unit (not shown in the figure).

In each first edge pressure adjustment unit PM1, the first retractable unit (not shown in the figure) is connected onto the first micro motor (not shown in the figure), and the first elastic unit (not shown in the figure) is disposed on the first retractable unit (not shown in the figure). The first retractable unit (not shown in the figure) may be adjusted in length by means of a torque change or force output change of the first micro motor (not shown in the figure). In addition, the first edge pressure adjustment units PM1 in the first edge region 11E may be designed to extend at different angles, such as a vertical angle, a horizontal angle, or an oblique angle, so that the first edge region 11E provides a better comfort.

Similarly, in each second edge pressure adjustment unit PM2, the second retractable unit (not shown in the figure) is connected onto the second micro motor (not shown in the figure), and the second elastic unit (not shown in the figure) is disposed on the second retractable unit (not shown in the figure). The second retractable unit (not shown in the figure) may be adjusted in length by means of a torque change or force output change of the second micro motor (not shown in the figure). In addition, the second edge pressure adjustment units PM1 in the second edge region 15E may be designed to extend at different angles, such as a vertical angle, a horizontal angle, or an oblique angle, so that the second edge region 15E provides a better comfort.

Referring to FIG. 16, the first retractable units (not shown in the figure) of the first edge pressure adjustment units PM1 disposed in the first edge region 11E can be flexibly adjusted in length in a vertical direction, and the first edge region 11E is higher than the first pressure adjustment module 14 in the central region.

The second retractable units (not shown in the figure) of the second edge pressure adjustment units PM2 disposed in the second edge region 15E can be flexibly adjusted in length in a vertical direction, and the second edge region 15E is higher than the second pressure adjustment module 15 in the central region.

In other embodiments, the first retractable units (not shown in the figure) of the first edge pressure adjustment units PM1 disposed in the first edge region 11E can be flexibly adjusted in length in a horizontal direction, and in this case, the seat module 11' is horizontally larger than the original size.

The second retractable units (not shown in the figure) of the second edge pressure adjustment units PM2 disposed in the second edge region 15E can be flexibly adjusted in length in a horizontal direction, and in this case, the back support module 13' is horizontally larger than the original size.

In addition, if multiple rows of the first edge pressure adjustment units PM1 and the second edge pressure adjustment units PM2 are respectively disposed in the first edge region 11E and the second edge region 13E, a small arc-shaped fence is formed around the seat module 11 and the back support module 13, so that the user is provided with a comfortable wrapping feeling.

Therefore, when the user sits in the chair device 1, the control module 18 sends a first edge control signal to the plurality of first edge pressure adjustment units PM1 of the first edge pressure adjustment module EPM1, so as to adjust the softness and comfort of the first edge region 11E. The control module 18 may also send a second edge control signal to the plurality of second edge pressure adjustment units PM2 of the second edge pressure adjustment module EPM2, so as to adjust the softness and comfort of the second edge region 13E.

In another embodiment, a first frame unit (not shown in the figure) may be disposed above the plurality of first edge pressure adjustment units PM1. That is, upon receiving the first edge control signal from the control module 18, the plurality of first edge pressure adjustment units PM1 may drive a gear mechanism, pneumatic device, or hydraulic device to adjust the position of the first frame unit (not shown in the figure). In this embodiment, the first frame unit (not shown in the figure) is a retractable connected frame tube and is disposed at one side of the first edge region 11E. When the first frame unit rises, a desired fencing effect is achieved around the seat module 11. In addition, the first frame unit (not shown in the figure) may be disposed in the seat module 11 or on the sides of the seat module 11.

A second frame unit (not shown in the figure) may be disposed above the plurality of second edge pressure adjustment units PM2. That is, upon receiving the second edge control signal from the control module 18, the plurality of second edge pressure adjustment units PM2 may drive a gear mechanism, pneumatic device, or hydraulic device to adjust the position of the second frame unit (not shown in the figure). In this embodiment, the second frame unit (not shown in the figure) is a retractable connected frame tube and is disposed at one side of the second edge region 13E. When the second frame unit rises, a desired fencing effect is achieved around the back support module 13. In addition, the second frame unit (not shown in the figure) may be disposed in the back support module 13 or on the sides of the back support module 13.

Third Embodiment

Figure 17:
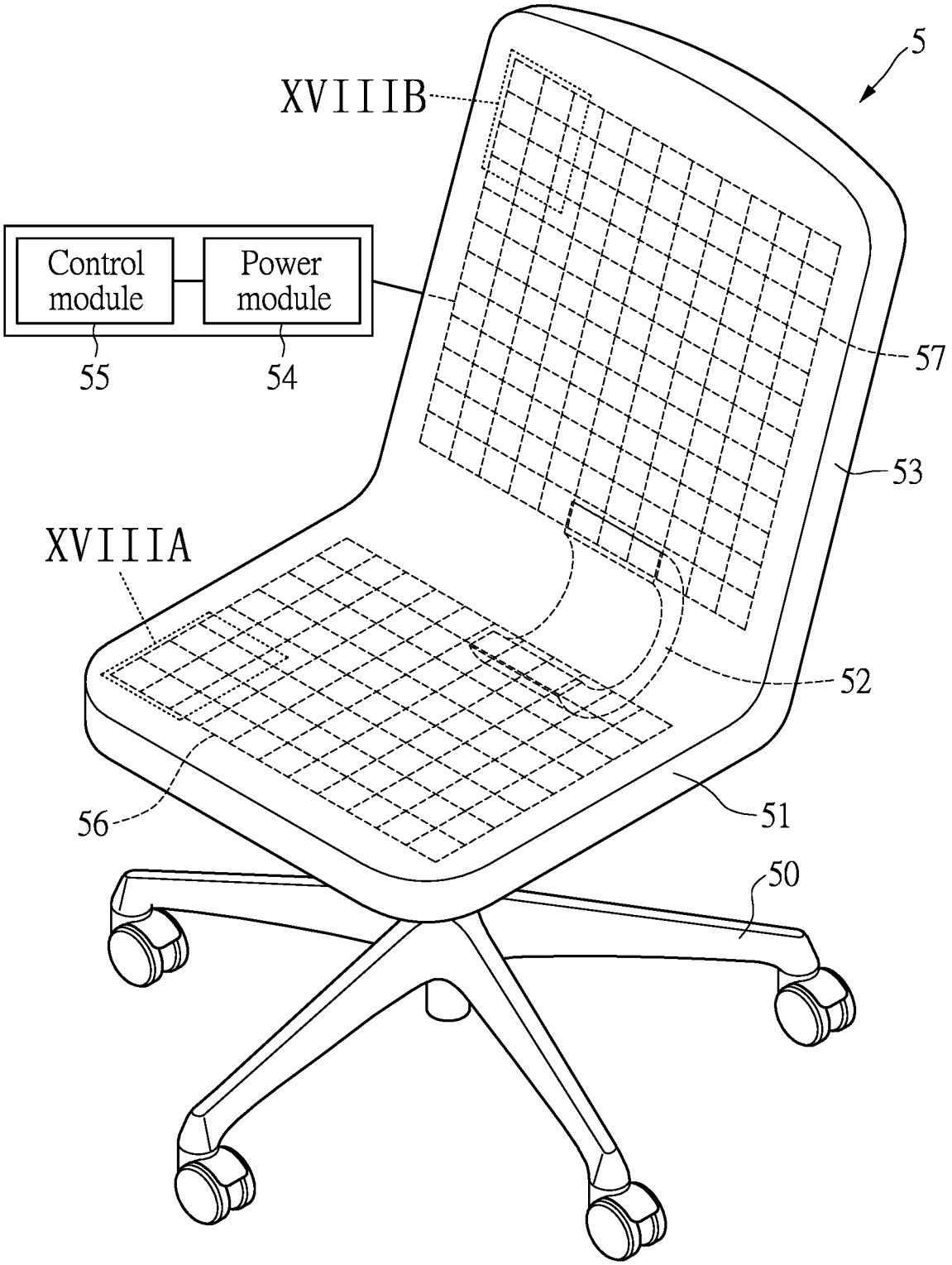
FIG. 17 is a schematic view of a chair device in a third embodiment of the present disclosure.
Figure 18A:
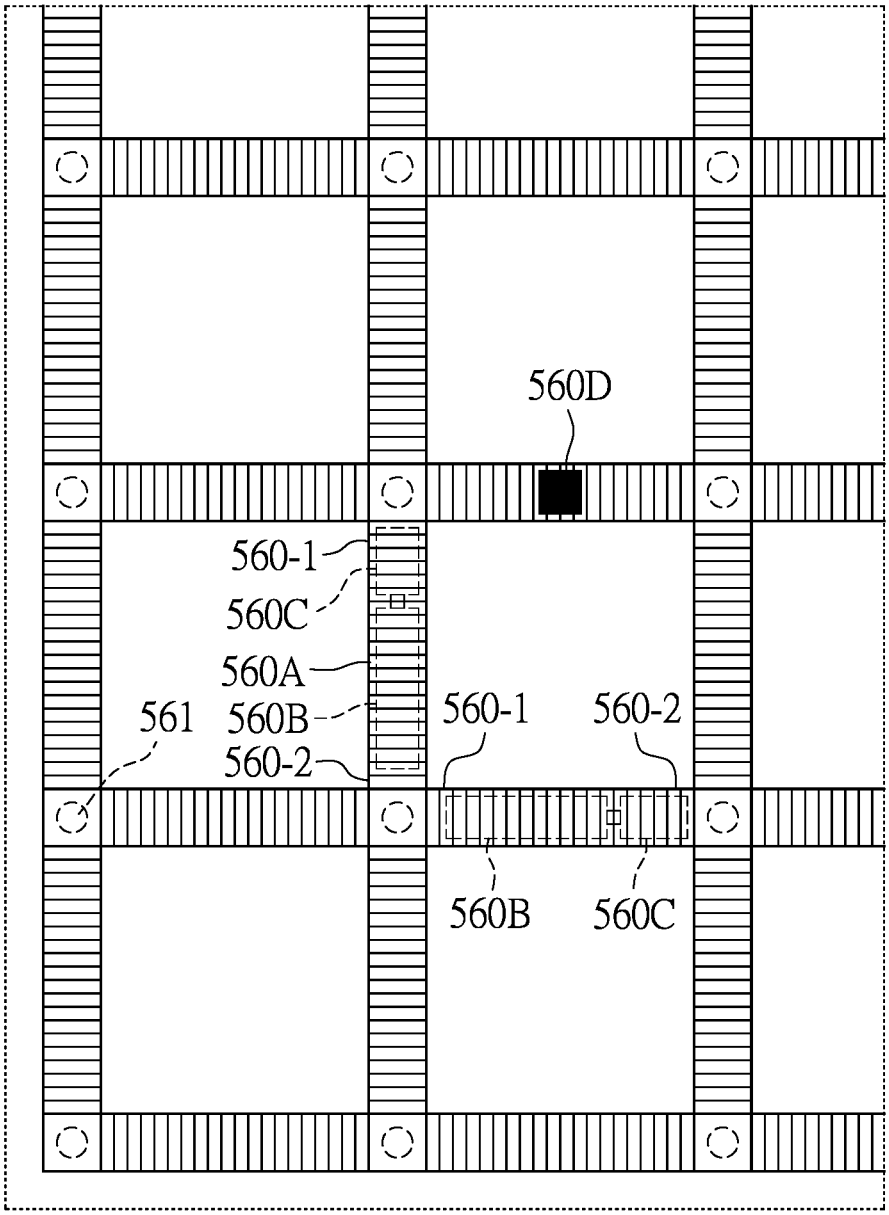
FIG. 18A is an enlarged schematic view of a region XVIIIA in FIG. 17.
Figure 18B:
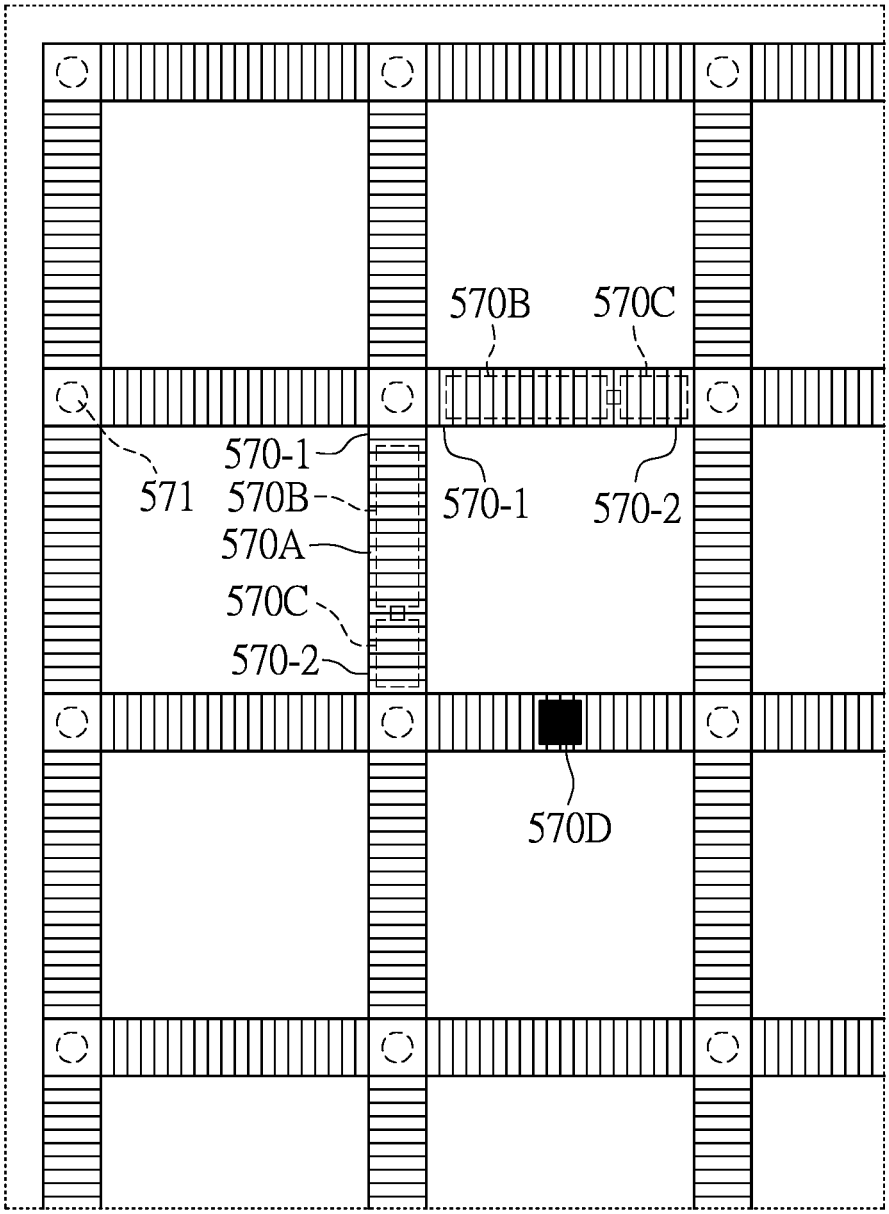
FIG. 18B is an enlarged schematic view of a region XVIIIB in FIG. 17.
Figure 19:
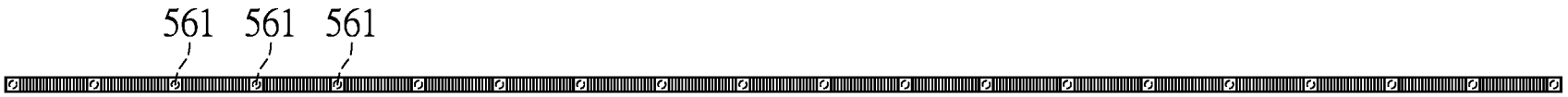
FIG. 19 is a schematic view showing a first propping structure of FIG. 17 in a flat state.
Figure 20:
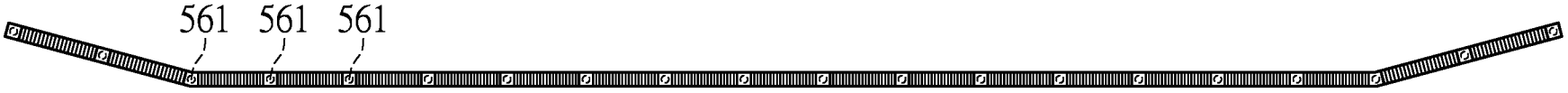
FIG. 20 is a schematic view showing that the first propping structure of FIG. 17 is bent at two sides.
Figure 21:
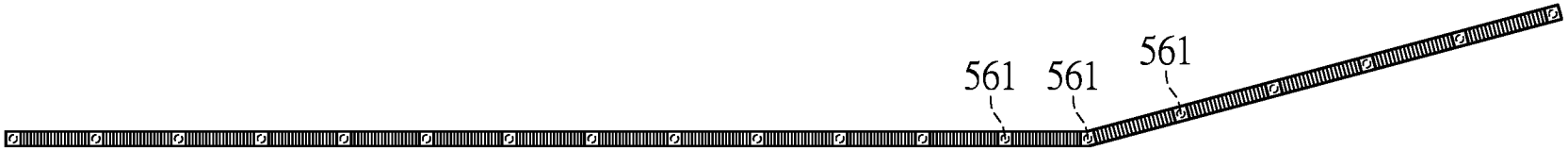
FIG. 21 is a schematic view showing the first propping structure of FIG. 17 being bent at one side.
Figure 22:
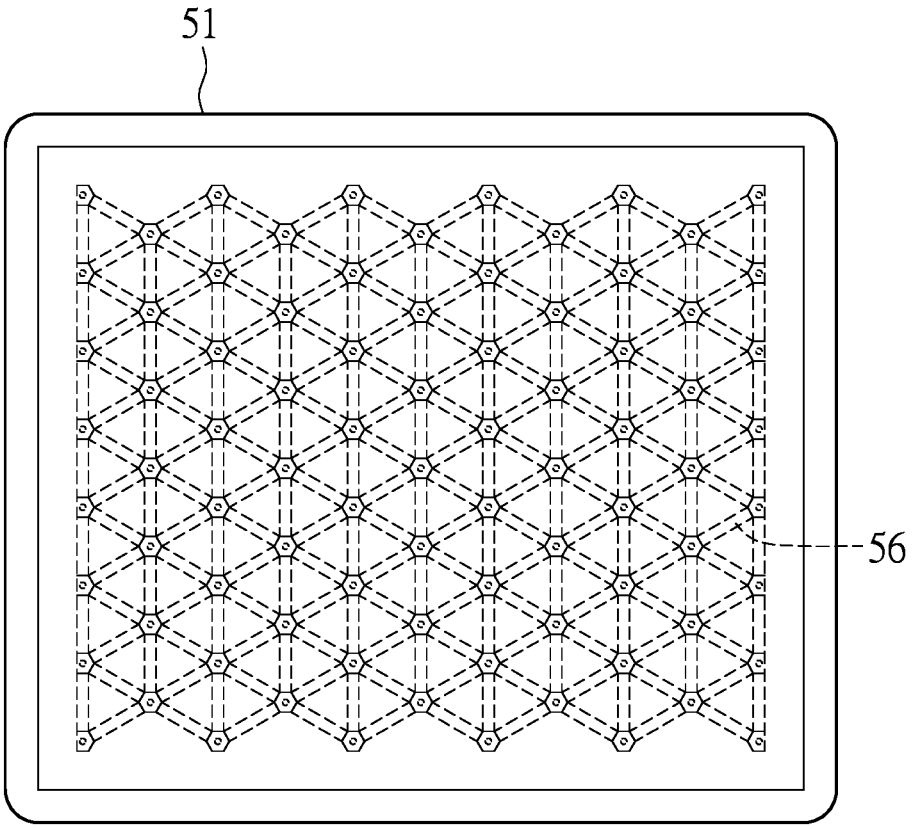
FIG. 22 is another schematic view showing the first propping structure of the seat module in FIG. 17.

Referring to FIGS. 17, 18A, 18B, 19, 20, 21, and 22, FIG. 17 is a schematic view of a chair device in a third embodiment of the present disclosure. FIG. 18A is a schematic enlarged diagram of a region XVIIIA in FIG. 17. FIG. 18B is a schematic enlarged diagram of a region XVIIIB in FIG. 17. FIG. 19 is a schematic view of a first propping structure in a flat state in FIG. 17. FIG. 20 is a schematic view showing that the first propping structure in FIG. 17 is bent at two sides. FIG. 21 is a schematic view showing that the first propping structure in FIG. 17 is bent at one side. FIG. 22 is another schematic view of the first propping structure in the seat module in FIG. 17.

Referring to FIGS. 17, 18A, and 18B, a chair device 5 in this embodiment includes a support stand 50, a seat module 51, a connection module 52, a back support module 53, a power module 54, a control module 55, a first propping structure 56, and a second propping structure 57.

The seat module 51 is disposed on the support stand 50, the connection module 52 is disposed at one side of the seat module 51, and the back support module 53 is connected to the connection module 52 and disposed at one side of the seat module 51.

The first propping structure 56 includes a plurality of first propping modules 560, and is disposed in the seat module 51. Each of the first propping modules 560 includes a first propping end 560-1 and a second propping end 560-2. The first propping end 560-1 of any one of the first propping module 560 is connected to a first propping end 560-2 or a second propping end 560-2 of another one of the first propping module 560. The plurality of first propping modules 560 in the first propping structure 56 are mutually connected to form a mesh structure.

The second propping structure 57 includes a plurality of second propping modules 570, and is disposed in the back support module 53. Each of the second propping modules 570 includes a first propping end 570-1 and a second propping end 570-2. The first propping end 570-1 of any one of the second propping module 570 is connected to a first propping end 570-1 or a second propping end 570-2 of another one of the second propping module 570. The plurality of second propping modules 570 in the second propping structure 57 are mutually connected to form a mesh structure.

Each first propping module 560 includes an elongated sleeve 560A, a micro motor 560B, and a connection unit 560C, in which the micro motor 560B and the connection unit 560C are disposed in the elongated sleeve 560A. The control module 55 is electrically connected to the micro motor 560B of each first propping module 560, and controls the micro motor 560B to adjust a connection length of the connection unit 560C. In this embodiment, the connection unit 560C is disposed on an axis of the micro motor 560B, and the connection length of the connection unit 560C may be adjusted by the movement of the micro motor. The elongated sleeve 560A is hollow and can accommodate the micro motor 560B and the connection unit 560C. Each second propping module 570 includes an elongated sleeve 570A, a micro motor 570B, and a connection unit 570C, in which the micro motor 570B and the connection unit 570C are disposed in the elongated sleeve 570A. The control module 55 is electrically connected to the micro motor 570B of each second propping module 570, and controls the micro motor 570B to adjust a connection length of the connection unit 570C. In this embodiment, the connection unit 570C is disposed on an axis of the micro motor 570B, and the connection length of the connection unit 570C may be adjusted by the movement of the micro motor. The elongated sleeve 570A is hollow and can accommodate the micro motor 570B and the connection unit 570C.

In this embodiment, each first propping module 560 further includes a pressure sensing unit 560D which is disposed on an inner surface or an outer surface of the elongated sleeve 560A. That is, the pressure sensing unit 560D can be disposed inside or outside the elongated sleeve 560A. In addition, each pressure sensing unit 560D is electrically connected to the control module 55, and is used to detect a pressure value applied on the elongated sleeve. The pressure value detected by each pressure sensing unit 560D is transmitted to the control module 55, and then the control module 55 adjusts the corresponding micro motor 560B and connection unit 560C according to the pressure. That is, in this embodiment, the pressure values applied by the user to the first propping structure 56 are distributed through the plurality of first propping modules 560 in a mesh structure. That is, the pressure values received by the first propping structure 56 are evenly shared by the plurality of first propping modules 560 distributed in a two-dimensional structure. Moreover, in addition to the force adjustment in a planar direction of the mesh structure, the plurality of first propping modules 560 of the first propping structure 56 are further subjected to some deformation in a vertical direction of the mesh structure.

Likewise, each second propping module 570 further includes a pressure sensing unit 570D which is disposed on an inner surface or an outer surface of the elongated sleeve 570A. That is, the pressure sensing unit 570D can be disposed inside or outside the elongated sleeve 570A. In addition, each pressure sensing unit 570D is electrically connected to the control module 55, and is used to detect a pressure value applied on the elongated sleeve. The pressure value detected by each pressure sensing unit 570D is transmitted to the control module 55, and then the control module 55 adjusts the corresponding micro motor 570B and connection unit 570C according to the pressure value. That is, in this embodiment, the pressure values applied by the user to the second propping structure 57 are distributed through the plurality of second propping modules 570 in a mesh structure. That is, the pressure value received by the second propping structure 57 are evenly shared by the plurality of second propping modules 570 distributed in a two-dimensional structure. Moreover, in addition to the force adjustment in a planar direction of the mesh structure, the second propping modules 570 of the second propping structure 57 are further subjected to some deformation in a vertical direction of the mesh structure.

The control module 55 is electrically connected to the power module 54. In addition, the power module 54 is further electrically connected to the plurality of micro motors 560B and pressure sensing units 560D in the plurality of first propping modules 560, and the plurality of micro motors 570B and pressure sensing units 570D in the plurality of second propping modules 570. That is, the power module 54 can supply power to the control module 55, the plurality of micro motors 560B and pressure sensing units 560D in the plurality of first propping modules 560, and the plurality of micro motors 570B and pressure sensing units 570D in the plurality of second propping modules 570.

In other embodiments, the pressure sensing units 560D and 570D may be selectively disposed in some regions to detect the pressure values applied by the user to the first propping structure 56 and the second propping structure 57, so that it is unnecessary to dispose one pressure sensing unit 560D on each first propping module 560 or dispose one pressure sensing unit 570D on each second propping module 570.

Referring to FIGS. 19, 20, and 21, the first propping structure 56 further includes a plurality of node connection modules 561. A plurality of connection portions (not shown in the figure) are provided around each node connection module 561 to connect with the first end 560-1 or the second end 560-2 of each first propping module 560. That is, at least two first propping modules 560 may be connected via the node connection module 561. In this embodiment, the first propping structure 56 can be bent and adjusted at different angles via the plurality of node connection modules 561. That is, the first ends 560-1 and the second ends 560-2 of the first propping modules 560 may be adjusted at different angles in the connection portions of the node connection modules 561, and may be held at an angle where the user wants to stay.

The second propping structure 57 further includes a plurality of node connection modules 571. A plurality of connection portions (not shown in the figure) are provided around each node connection module 571 to connect with the first end 570-1 or the second end 570-2 of each second propping module 570. That is, at least two second propping modules 570 may be connected via the node connection module 571. In this embodiment, the second propping structure 57 can be bent and adjusted at different angles via the plurality of node connection modules 571. That is, the first ends 570-1 and the second ends 570-2 of the second propping modules 570 may be adjusted at different angles in the connection portions of the node connection modules 571, and may be held at an angle where the user wants to stay.

FIGS. 19, 20, and 21 all use the first propping structure 56 as an example for description. FIG. 19 shows that the first propping structure 56 is not bent and in a flat state, FIG. 20 shows that the first propping structure 56 is bent at two sides, and FIG. 21 shows that the first propping structure 56 is bent at one side. In other embodiments, the first propping structure 56 or the second propping structure 57 may be bent in the middle to form a seat and a back support.

That is, in this embodiment, the first propping structure 56 and the second propping structure 57 are disposed in the seat module 51 and the back support module 53, respectively. In other embodiments, the seat module 51 and the back support module 53 may be integrated, and a propping structure identical with the first propping structure 56 or the second propping structure 57 is disposed therein. According to the feature that the first propping structure 56 or the second propping structure 57 can be bent in sections in this embodiment, a propping device for both sitting and lying is obtained. The propping device can be bent to form a chair device having a back support, can also be flattened to form a mattress device for lying, and even can be bent at one side to form the shape of a pillow, so as to provide better user experience.

Referring to FIG. 22, the mesh structure formed by connection of the plurality of propping modules 560 in FIG. 22 are realized by being based on a triangular shape. In other embodiments, the mesh structure formed by connection of the plurality of propping modules 560 may be a connected structure in the shape of a triangle, square, or rectangle, or in an irregular shape.

In this embodiment, the first propping structure 56 and the second propping structure 57 are respectively disposed in the seat module and the back support module, and serve as propping material layers. A comfortable material layer may also be disposed on the seat module and the back support module to improve the comfortable experience.

Fourth Embodiment

Figure 23:
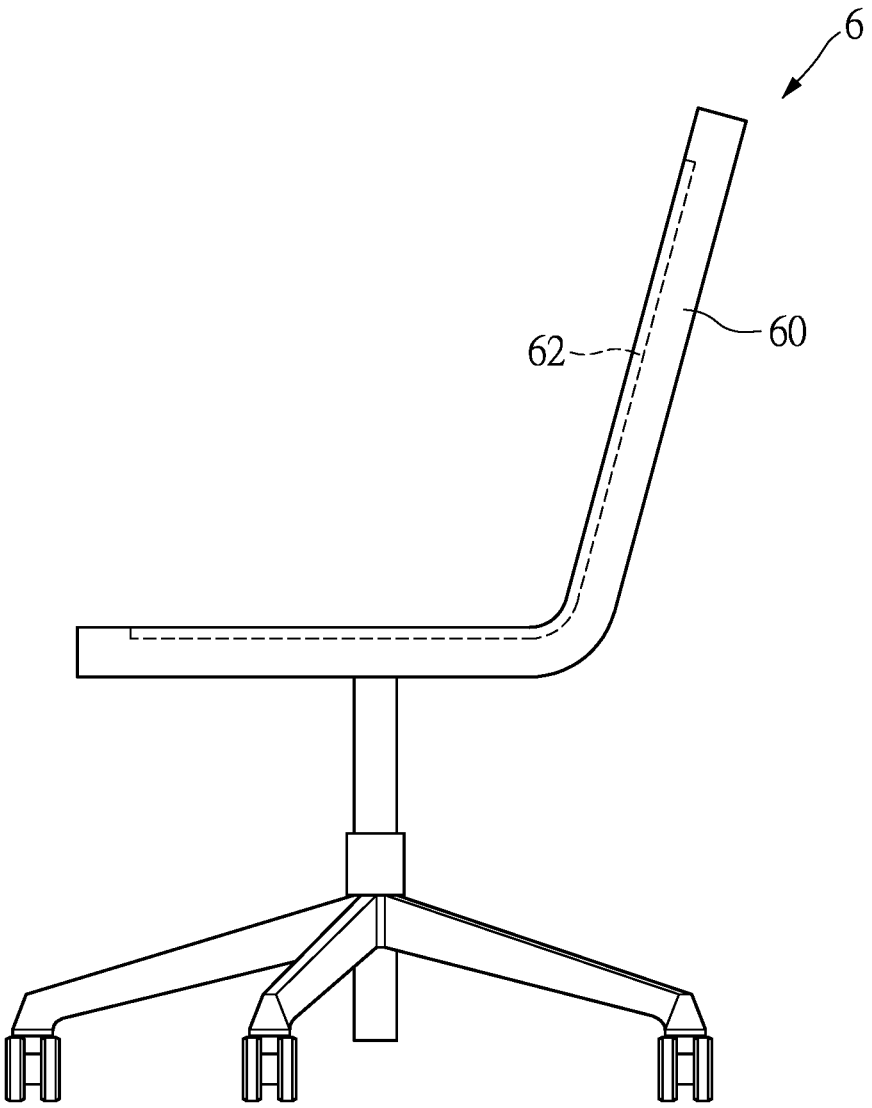
FIG. 23 is a schematic view of a chair device in a fourth embodiment of the present disclosure.
Figure 24:
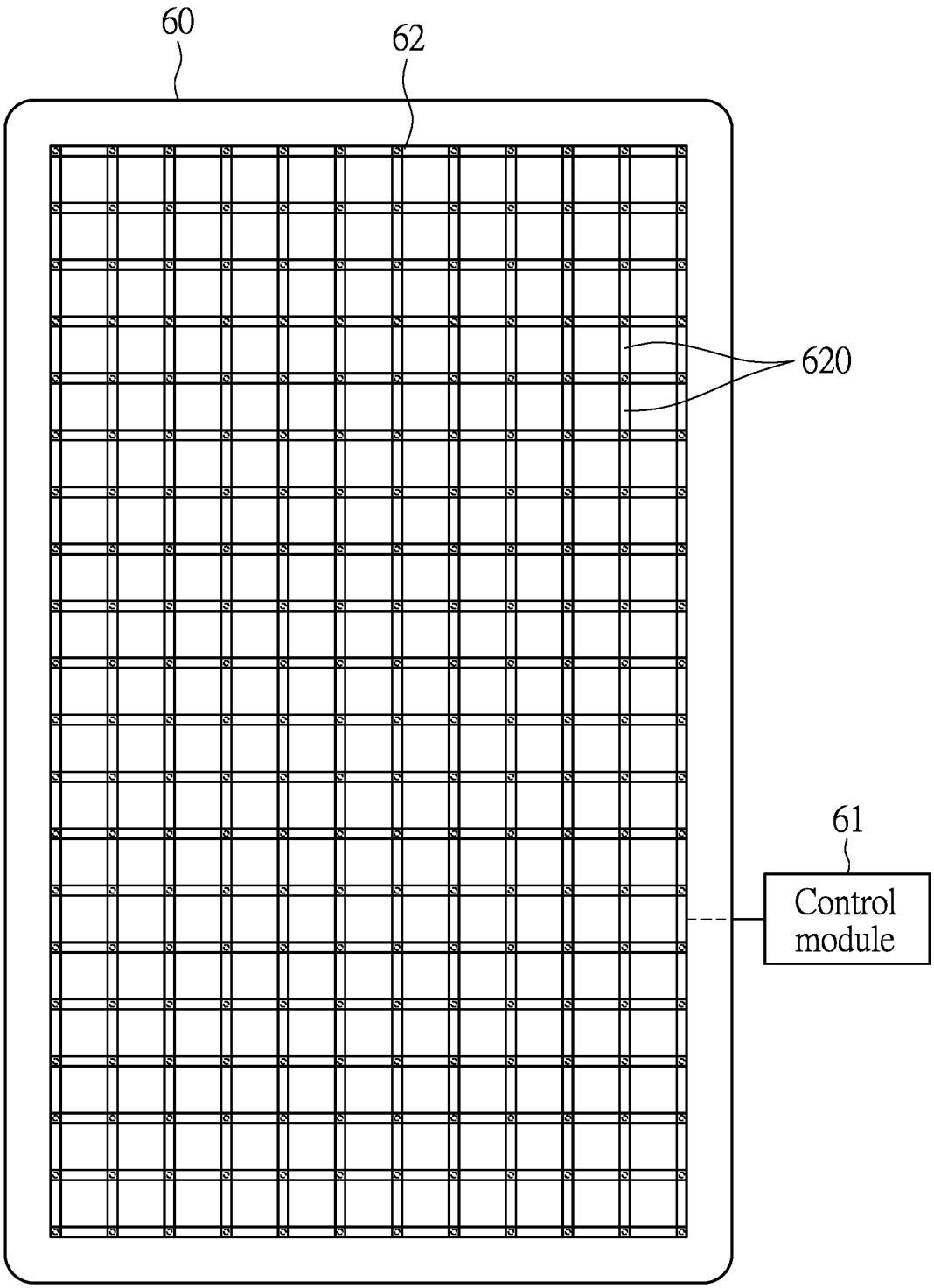
FIG. 24 is another schematic view of the chair device in FIG. 23.

Referring to FIGS. 23 and 24, FIG. 23 is a schematic view of a chair device in a fourth embodiment of the present disclosure, and FIG. 24 is another schematic view of the chair device in FIG. 23.

In this embodiment, a mesh structure formed by connection of a plurality of propping modules in a propping structure 62 is directly used as a propping material layer to form, for example, a folding mattress device.

In this embodiment, a propping device 6 includes a frame 60, a control module 61, and a propping module 62. The structure and function of the control module 61 and the propping module 62 are similar to those of the control module 55, the first propping structure 56, and the second propping structure 57 in the previous embodiment, and will not be reiterated herein. In this embodiment, the mesh structure formed by connection of the plurality of propping modules 620 are connected to the frame 60. The propping device 6 in this embodiment may be bent in sections in the above-described manner to form a propping device for both sitting and lying. The propping device can be bent to form a chair device having a back support, can also be flattened to form a mattress device for lying, and even can be bent at one side to form the shape of a pillow, so as to provide better user experience.

Figure 25:
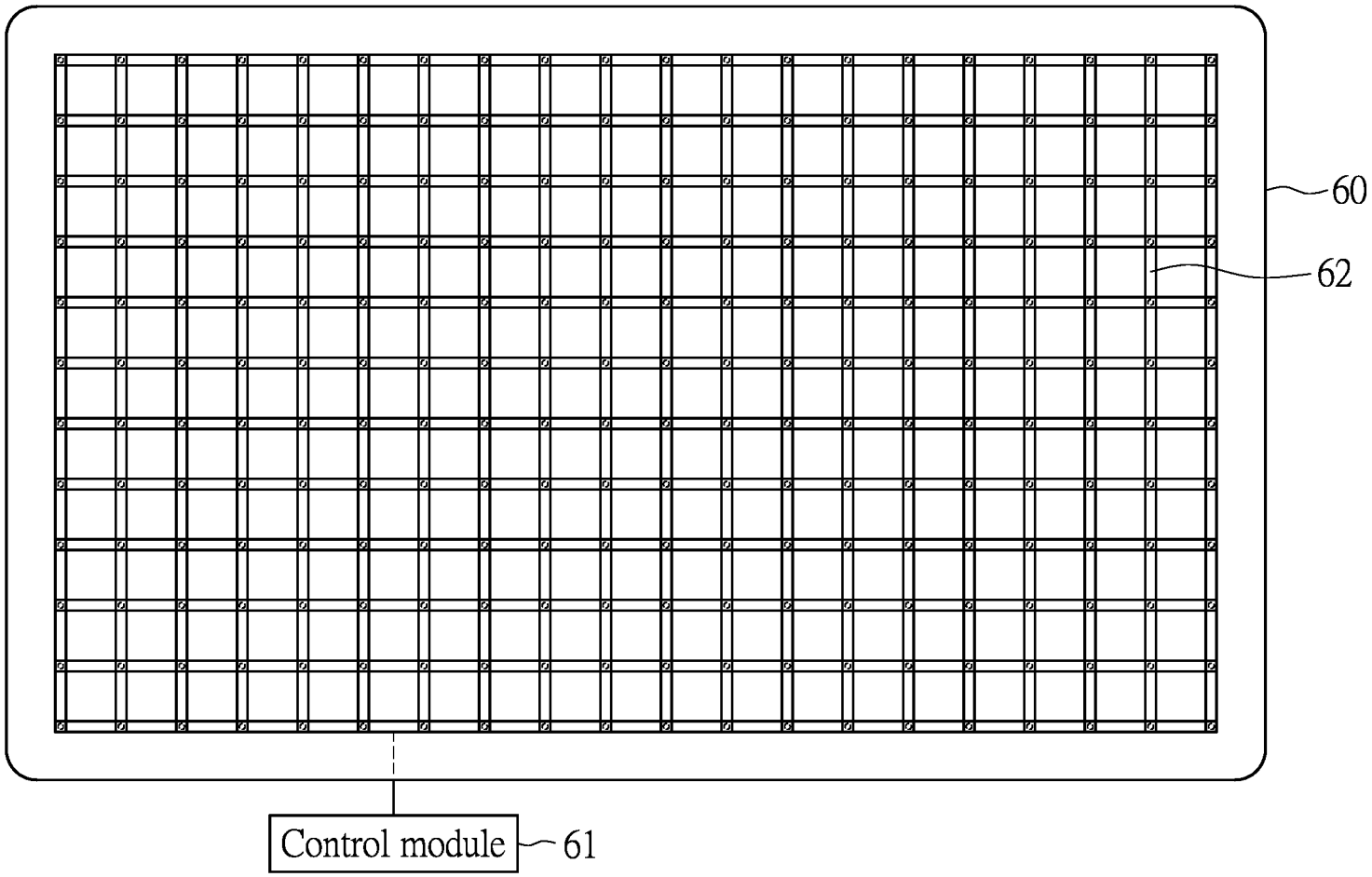
FIG. 25 is a schematic view of a mattress device in a fourth embodiment of the present disclosure.

Referring to FIG. 25, FIG. 25 is a schematic view of a mattress device in the fourth embodiment of the present disclosure.

In this embodiment, the mesh structure formed by connection of the plurality of propping modules 620 are directly used as a propping material layer to form, for example, a folding mattress device.

Fifth Embodiment

Figure 26:
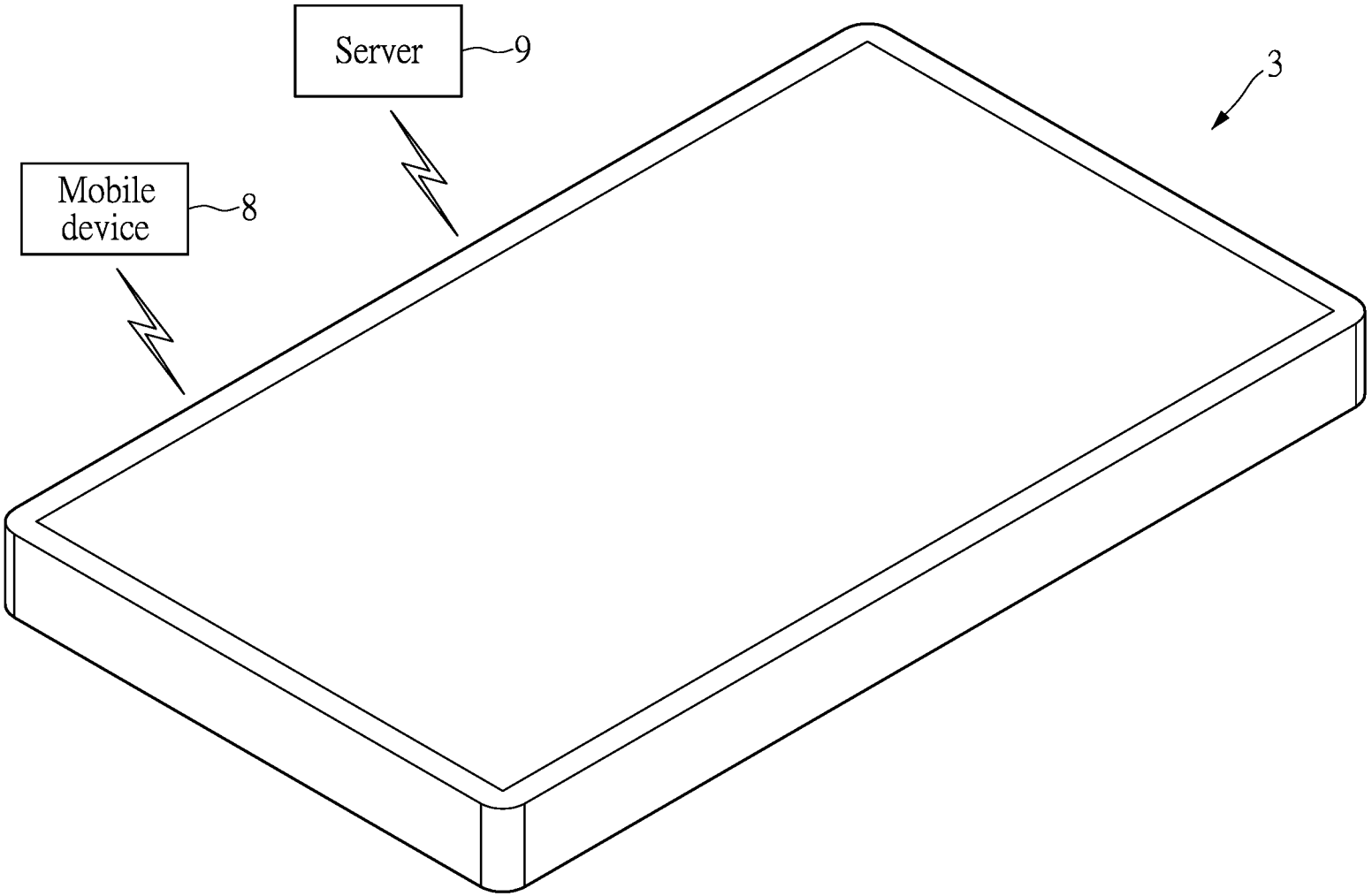
FIG. 26 is a schematic view of a mattress device in an embodiment of the present disclosure.
Figure 27:
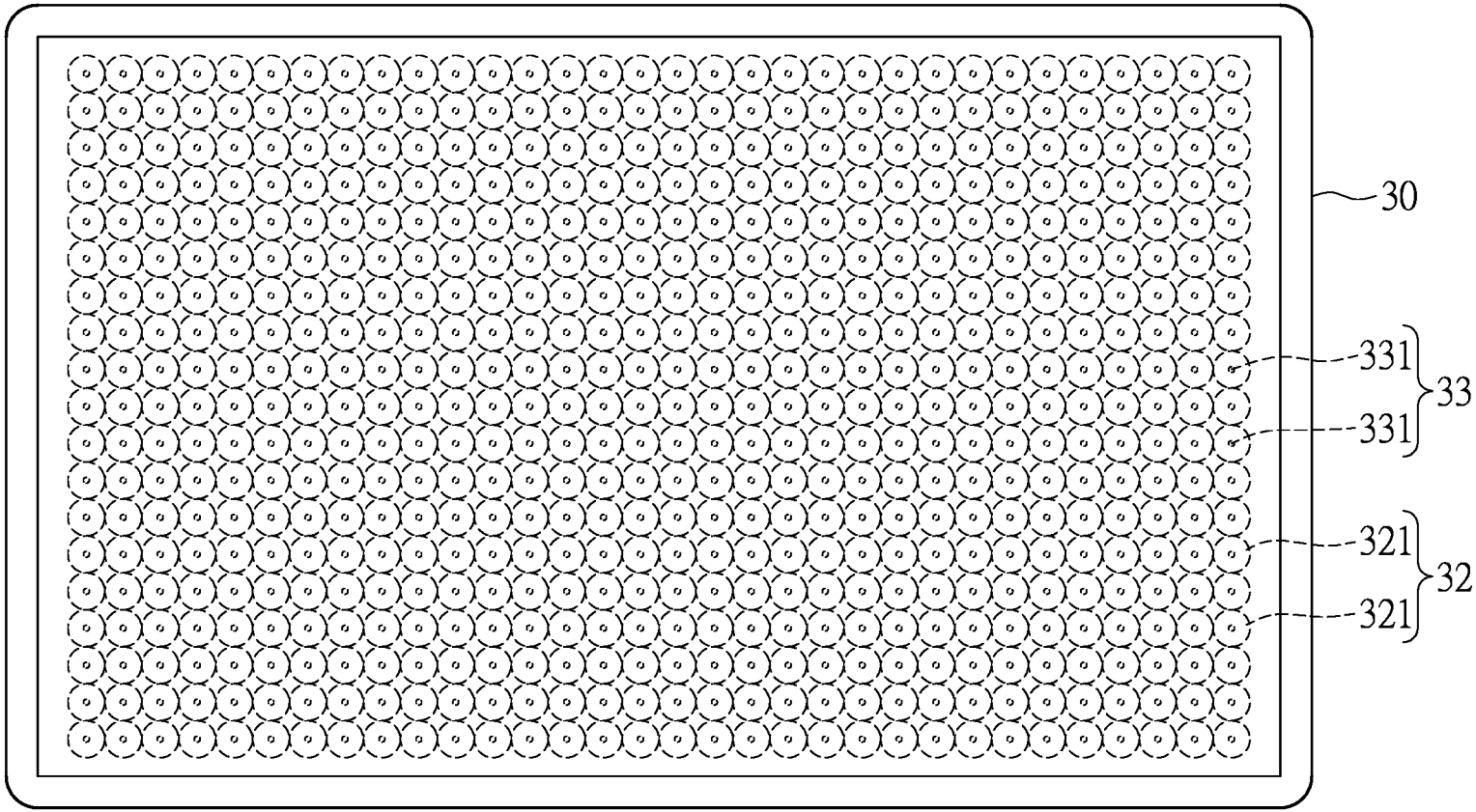
FIG. 27 is a schematic view showing that a pressure adjustment module is disposed in the mattress device in an embodiment of the present disclosure.
Figure 28:
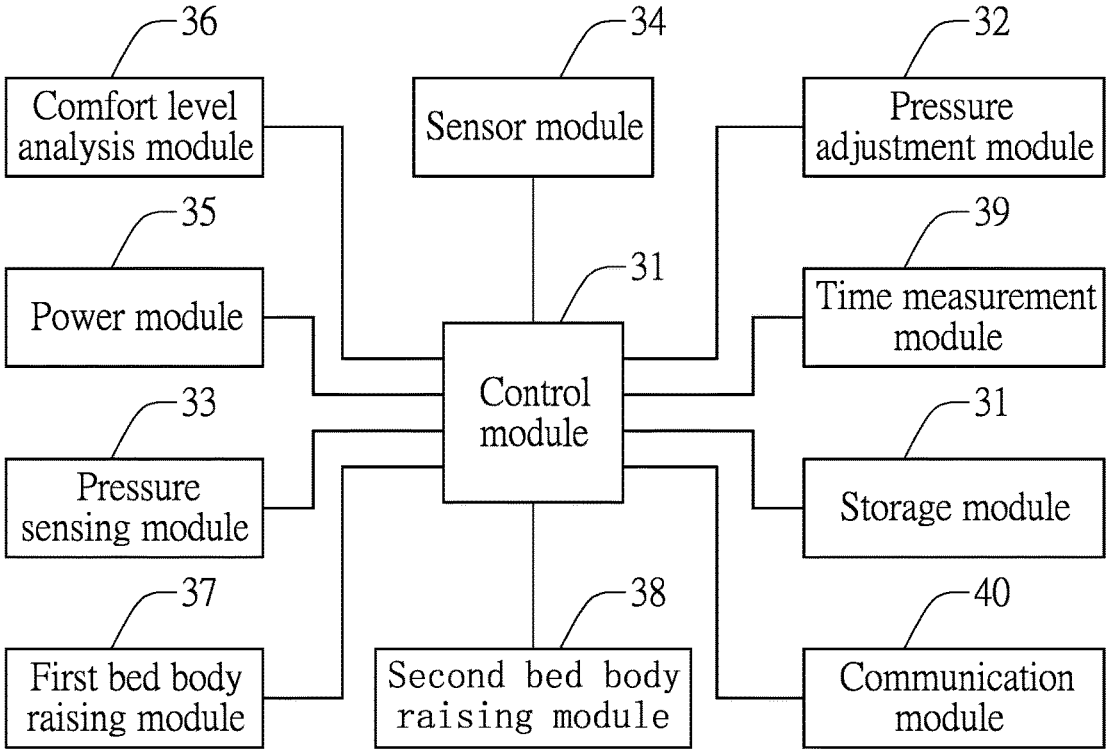
FIG. 28 is a block diagram of the mattress device in an embodiment of the present disclosure.

Referring to FIGS. 26, 27, and 28, FIG. 26 is a schematic view of a mattress device in an embodiment of the present disclosure, FIG. 27 is a schematic view showing that a pressure adjustment module is disposed in the mattress device in an embodiment of the present disclosure, and FIG. 28 is a block diagram of the mattress device in an embodiment of the present disclosure.

A mattress device 3 includes a mattress module 30, a control module 31, a pressure adjustment module 32, a pressure sensing module 33, a sensor module 34, a power module 35, and a comfort level analysis module 36. The pressure adjustment module 32 and the pressure sensing module 33 are both disposed in the mattress module 30, and the control module 31 may be disposed inside or outside the mattress module 30.

The mattress module 30 includes a comfortable material layer 301 and a propping material layer 302. The pressure adjustment module 32 and the pressure sensing module 33 are disposed between the comfortable material layer 301 and the propping material layer 302. That is, the comfortable material layer 301 is disposed above the pressure adjustment module 32 and the pressure sensing module 33. The comfortable material layer 301 may be made from fabric or foam; and the propping material layer 302 may be made from wood, plastic, or metal.

The power module 35 is electrically connected to the control module 31, the pressure adjustment module 32, the pressure sensing module 33, and the sensor module 34, so as to supply power to the control module 31, the pressure adjustment module 32, the pressure sensing module 33, and the sensor module 34. The power module 35 is an AC-to-DC voltage converter or a DC-to-AC voltage converter. The pressure sensing module 33 is formed by a pressure sensor module printed on a flexible substrate or a plurality of independently disposed pressure sensors.

The pressure adjustment module 32 includes a plurality of pressure adjustment units 321 which are separately electrically connected to the control module. In this embodiment, the plurality of pressure adjustment units 321 are arranged in a matrix.

The pressure sensing module 33 includes a plurality of pressure sensing units 331, and each of the pressure sensing units 331 is disposed at one side of the corresponding pressure adjustment unit 321. That is, in this embodiment, the pressure sensing units 331 collocate with the pressure adjustment units 321 in a one-to-one correspondence manner. A first side of each pressure adjustment unit 321 is disposed on the propping material layer 302, and a second side of the pressure adjustment unit 321 is in contact with the comfortable material layer 301. The pressure sensing unit 331 is disposed on the second side of the pressure adjustment unit 321. The plurality of pressure sensing units 331 are used to detect pressures applied by a user who lies on the mattress module 30 to different places on the mattress module 30. That is, each pressure sensing unit 331 can obtain a sensed pressure signal after detection, and transmits the signal to the control module 31.

When the plurality of sensed pressure signals from the plurality of pressure sensing units 331 of the pressure sensing module 33 are transmitted to the control module 31, the control module 31 adjusts each of the pressure adjustment units 321 in the pressure adjustment module 32 individually according to the plurality of sensed pressure signals from the plurality of pressure sensing units 331. That is, in this embodiment, each pressure adjustment unit 321 in the pressure adjustment module 32 is adjusted individually.

The control module 31 is a CPU, an ASIC, or an MCU.

Figure 29:
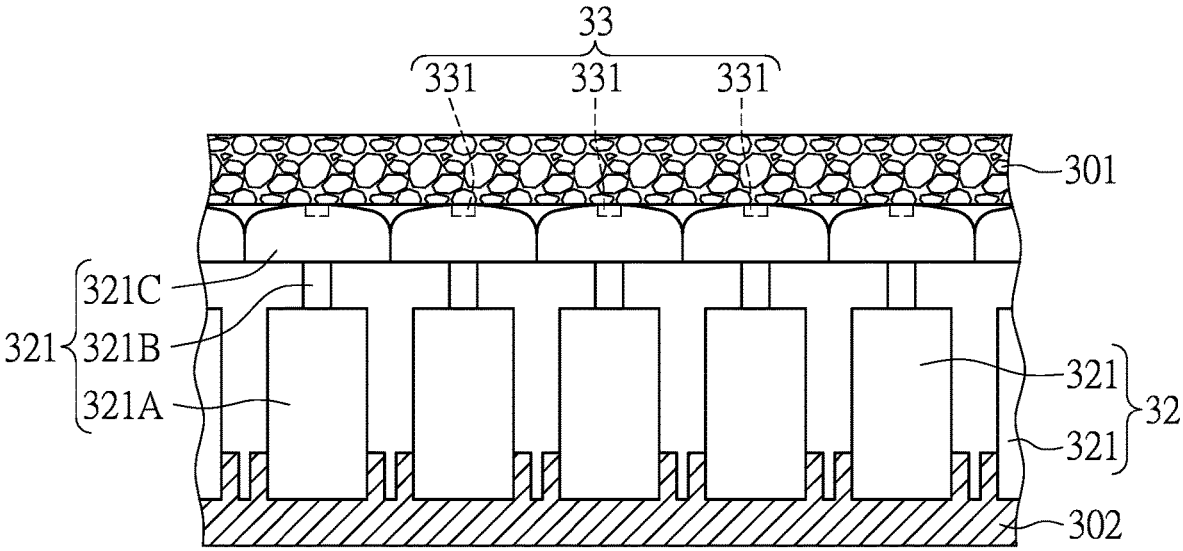
FIG. 29 is a schematic view of a pressure adjustment module in an embodiment of the present disclosure.

Referring to FIG. 29, FIG. 29 is a schematic view of the pressure adjustment module in the embodiment of the present disclosure.

In this embodiment, each pressure adjustment unit 321 includes a micro motor 321A, a connection unit 321B, and an elastic unit 321C. The connection unit 321B is connected onto the micro motor 321A, and the elastic unit 321C is disposed on the connection unit 321B. In this embodiment, the micro motor 321A is vertically connected to the elastic unit 321C, and implements a back-and-forth movement stroke. That is, when the pressure adjustment unit 321 is vertically disposed, the micro motor 321A can be vertically adjusted to different heights.

Figure 30:
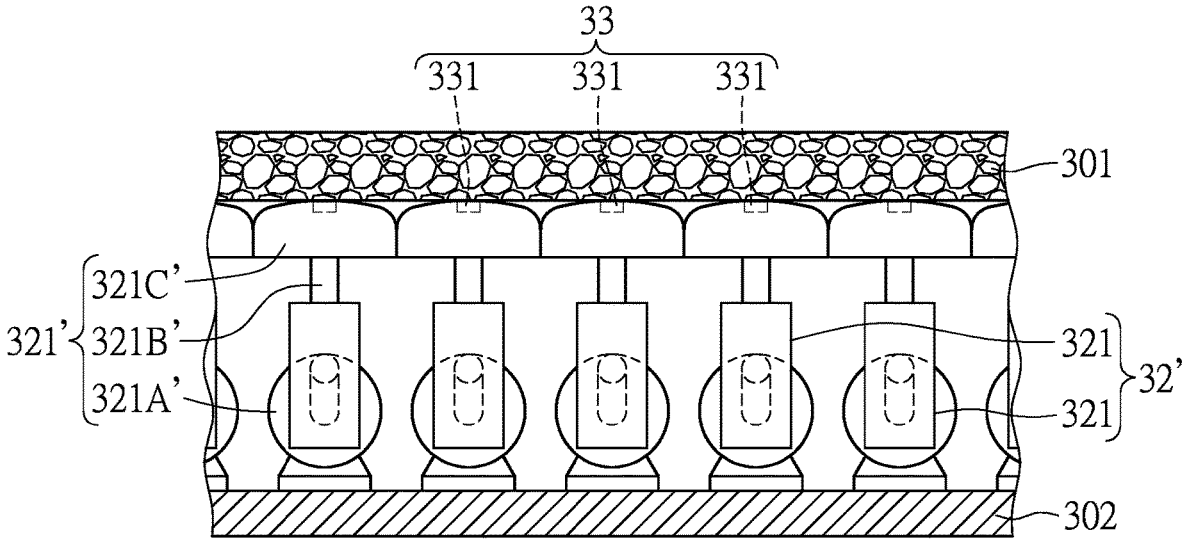
FIG. 30 is another schematic view of the pressure adjustment module in an embodiment of the present disclosure.

Referring to FIG. 30, FIG. 30 is another schematic view of the pressure adjustment module in the embodiment of the present disclosure.

In this embodiment, each pressure adjustment unit 321' includes a micro motor 321A', a connection unit 321B', and an elastic unit 321C'. The connection unit 321B' is connected onto the micro motor 321A', and the elastic unit 321C' is disposed on the connection unit 321B'. In this embodiment, the micro motor 321A' is horizontally linked to the elastic unit 321C', and a central axis of the micro motor 321A' is connected to the connection unit 321B'. These micro motors 321A' are small in size and are densely arranged, and can therefore provide a better lying experience. Especially, since the micro motors 321A and 321A' in the present disclosure are densely arranged and capable of being adjusted in real time, the micro motors 321A and 321A' can provide a user who lies down to have a wrapping feeling and a comfortable lying experience.

In this embodiment, the elastic units 321C and 321C' may be made from rubber or foam, the connection unit 321B is a metal sleeve, and the connection unit 321B' includes an eccentric wheel and a linked metal arm.

Figure 31:
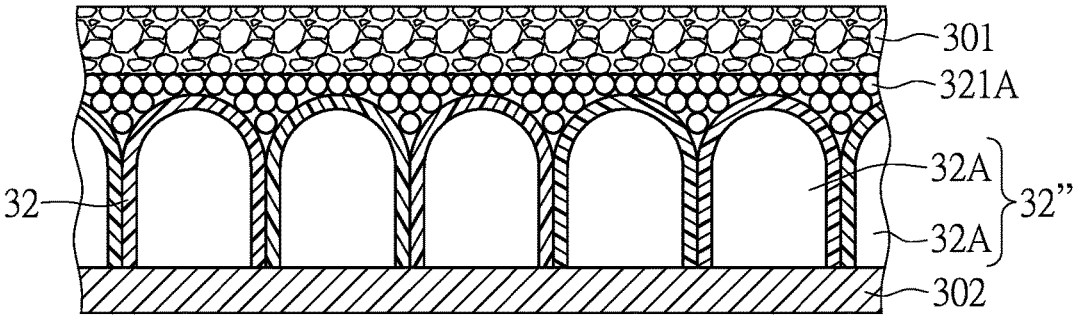
FIG. 31 is still another schematic view of the pressure adjustment module in an embodiment of the present disclosure.
Figure 32:
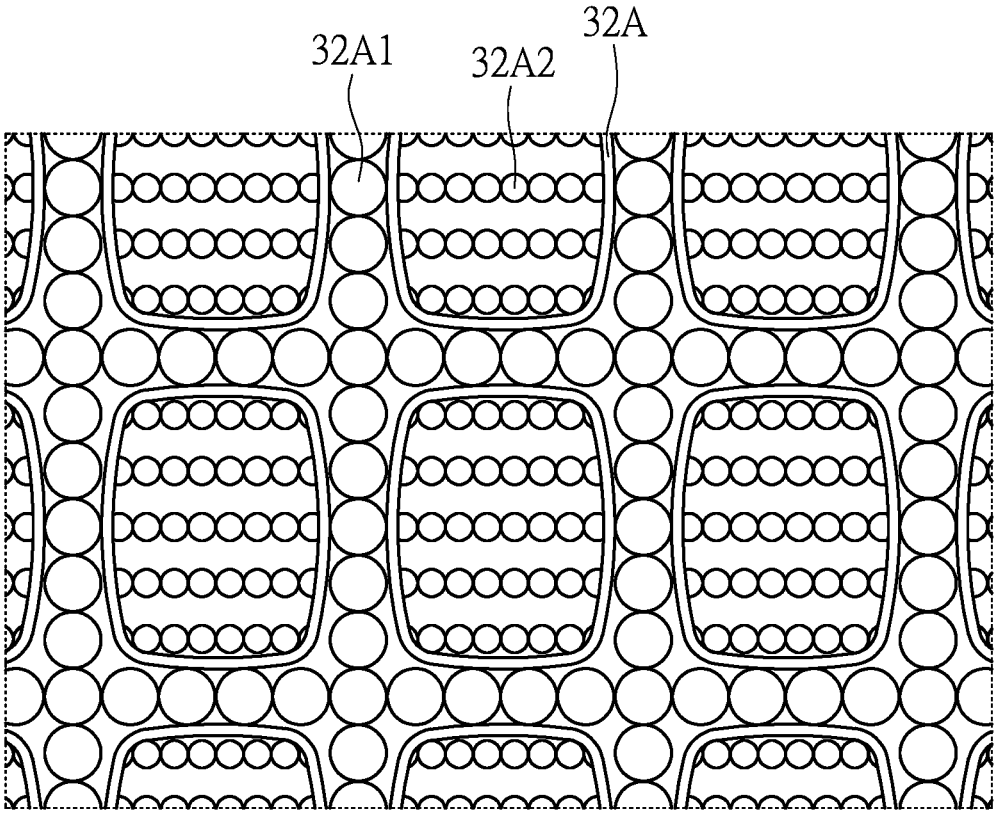
FIG. 32 is a schematic view showing first spherical objects and second spherical objects configured in the pressure adjustment module of FIG. 6.
Figure 33:
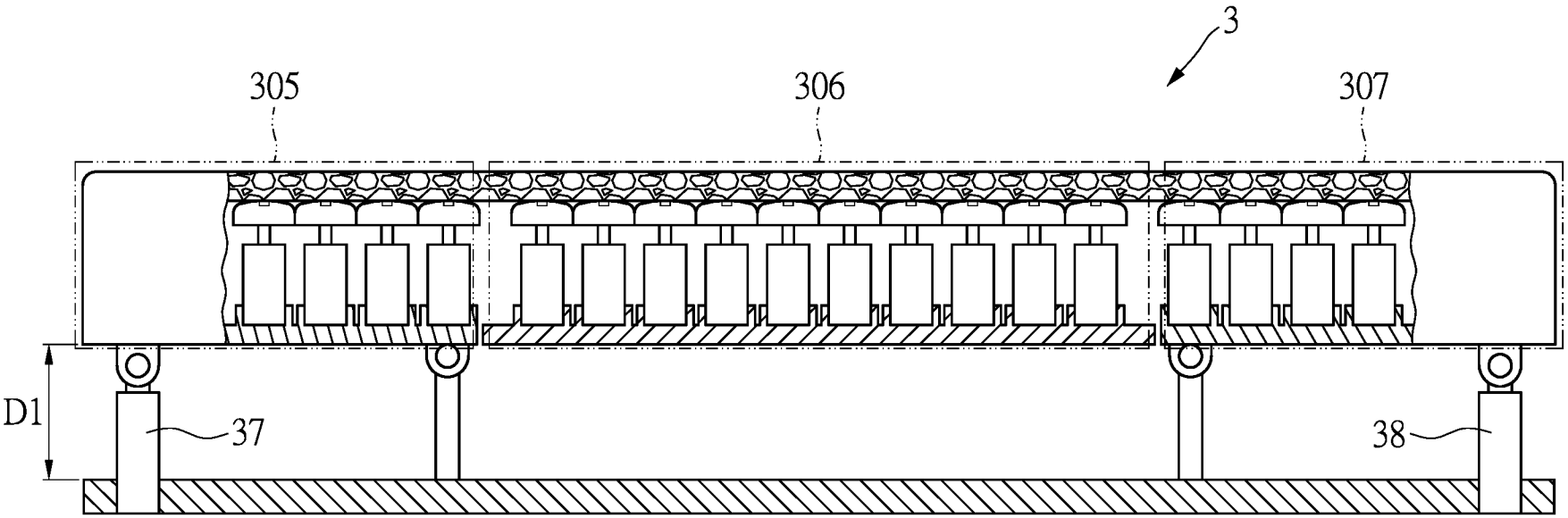
FIG. 33 is a schematic view showing a first bed body raising module and a second bed body raising module being disposed below a mattress module in an embodiment of the present disclosure.

Referring to FIGS. 31 and 32, FIG. 33 is still another schematic view of the pressure adjustment module in an embodiment of the present disclosure, and FIG. 32 is a schematic view of first spherical objects and second spherical objects in the pressure adjustment module in FIG. 31.

In this embodiment, the pressure adjustment module 32' includes a plurality of airbag units 32A and a pump (not shown in the figure). The plurality of airbag units 32A are connected to the pump, and the pump (not shown in the figure) is used to inflate or deflate the airbag units 32A separately, so as to implement pressure adjustment. Similar to the arrangement in the foregoing embodiment, the comfortable material layer 301 is also disposed above the plurality of airbag units 32A of the pressure adjustment module 32'. Similarly, each airbag unit 32A may be inflated or deflated independently, so as to implement pressure adjustment. These airbag units 32A are each designed into a small-sized airbag, and are densely arranged, thus providing a better lying experience.

Referring to FIG. 32, FIG. 32 is a schematic view showing that a plurality of spherical objects is disposed on the plurality of airbag units 32A of the pressure adjustment module 32'.

This embodiment involves two types of spherical objects, one of which being a big first spherical object 32A1 and the other one being a small second spherical object 32A2. The big first spherical objects 32A1 are disposed in gaps between the airbag units 32A, and the small second spherical objects 32A2 are disposed on the surfaces of the airbag units 32A. The first spherical objects 32A1 and the second spherical objects 32A2 are both connected in series via a steel wire or plastic wire, so that the first spherical objects 32A1 and the second spherical objects 32A2 can be disposed on the pressure adjustment module 32'. The first spherical objects 32A1 and the second spherical objects 32A2 are steel beads, ceramic beads, plastic beads, or the like, and are in contact with the comfortable material layer 301 in a point contact mode.

As shown in FIG. 32, the first spherical objects 32A1 and the second spherical objects 32A2 in this embodiment are both arranged in a matrix, and may be arranged in the shape of a triangle, quadrangle, hexagon, or polygon in other embodiments.

In this embodiment, the sensor module 34 is mainly used to detect mattress environmental parameters of the mattress module 30. The sensor module 34 includes at least a gyro sensor or a vibration sensor. The mattress environmental parameters include at least a vibration status of a mattress module 30.

In addition, the sensor module 34 may further include a temperature sensor or a humidity sensor used to detect the temperature or humidity of the surface of the mattress module.

The sensor module 34 may further include an image sensor, an infrared sensor, a laser ranging sensor, an optical sensor, an olfactory gas sensor, or a weight sensor.

The comfort level analysis module 36 receives the mattress environmental parameters from the sensor module 34 and the plurality of sensed pressure signals from the plurality of pressure sensing units 331 of the pressure sensing module 33, so as to determine a comfort level when the user lies on the mattress device 3.

That is, when the user lies on the mattress device 3, the plurality of pressure sensing units 331 of the pressure sensing module 33 detects a pressure value which is applied by the user on the comfortable material layer 301 of the mattress module 30, and transmits sensed pressure signals obtained after detection to the control module 30. The control module 30 then transmits these sensed pressure signals to the comfort level analysis module 36. In addition, the mattress environmental parameters detected by the sensor module 14 are also transmitted to the comfort level analysis module 36 for analysis.

The comfort level analysis module 36 first makes analysis according to the mattress environmental parameters. When a vibration status in the mattress environmental parameters is greater than a vibration default value, it is determined that the comfort level is low. Further, the comfort level analysis module 36 analyzes the plurality of sensed pressure signals, and searches for a region that has a high pressure value. When a maximum pressure value of a region is greater than N times of a surrounding pressure value, the comfort level analysis module 36 provides a low-comfort pressure adjustment signal to the control module 30, so that the control module 30 adjusts corresponding pressure adjustment units 321 of the pressure adjustment module 32 to reduce a pressure difference value of a region that has a large pressure difference. N is greater than or equal to 1, and is a rational number. That is, the control module 10 adjusts the region that has a large pressure difference in the sensed pressure signals according to the low-comfort pressure adjustment signal. Afterwards, the comfort level analysis module may continuously monitor a lying status of the user according to the mattress environmental parameters.

Figure 34:
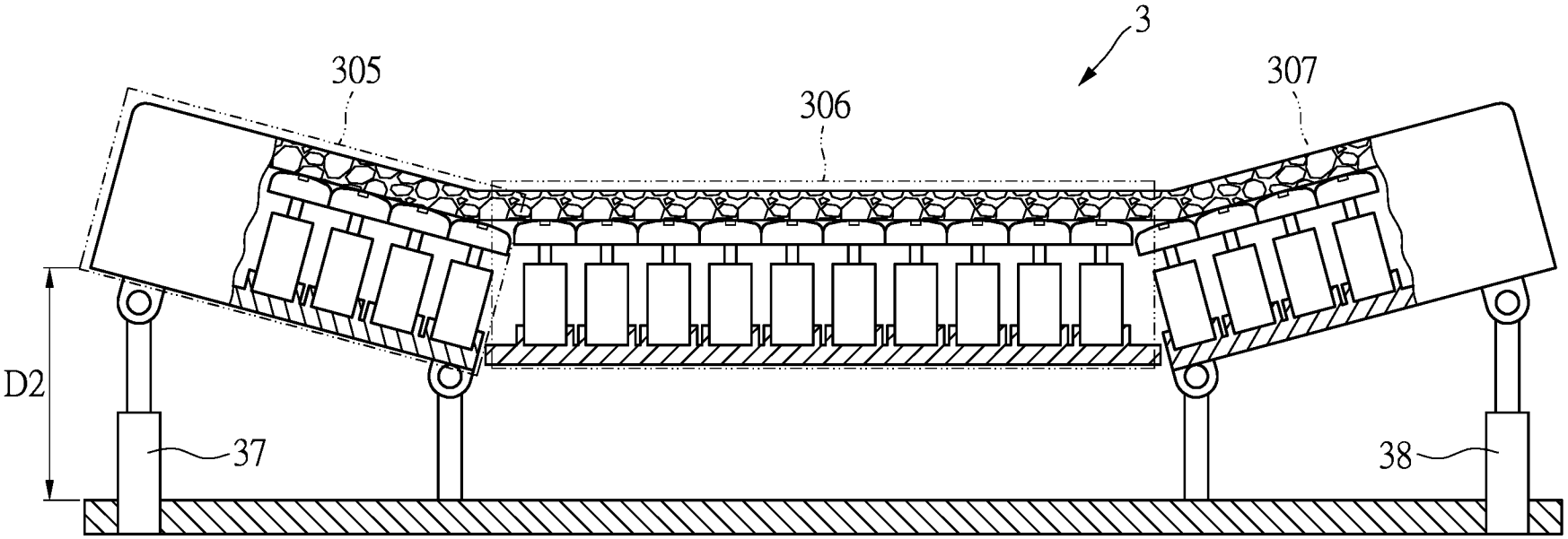
FIG. 34 is a schematic view showing the first bed body raising module and the second bed body raising module being used to adjust the height of a bed body in an embodiment of the present disclosure.

Referring to FIGS. 33 and 34, FIG. 33 is a schematic view showing that a first bed body raising module and a second bed body raising module are disposed below the mattress module in an embodiment of the present disclosure. FIG. 34 is a schematic view showing that the first bed body raising module and the second bed body raising module are used to adjust the height of a bed body in an embodiment of the present disclosure.

The mattress device 3 further includes a first bed body raising module 37 and a second bed body raising module 38 which are respectively disposed at two sides of the mattress module 10. In this embodiment, the mattress module 10 includes at least three mattress units which are a first mattress unit 305, a second mattress unit 306, and a third mattress unit 307.

The first mattress unit 305, the second mattress unit 306, and the third mattress unit 307 are all arranged in a matrix. The first bed body raising module 37 and the second bed body raising module 38 are disposed respectively below the first mattress unit 305 and the third mattress unit 307 at the two sides of the mattress module 30, and are used to raise the two mattress units 305 and 307. In this embodiment, the first bed body raising module 37 and the second bed body raising module 38 separately include a motor (not shown in the figure) and a jack unit 371. Moreover, the first bed body raising module 37 and the second bed body raising module 38 are electrically connected to the control module 31, so as to receive a bed body raising signal from the control module 31.

In this embodiment, after the user lies down for a period of time, the control module 31 may send a bed body raising signal to the first bed body raising module 37, so as to increase the height of the first bed body raising module 37. Thus, the first mattress unit 305 of the mattress module 30 is raised from a first height D1 to a second height D2 to form a tilted curve, so that the user can turn over in this case. When detecting a sensed pressure distribution information that indicates the user has turned over, the control module 11 sends a reply signal to the first bed body raising module 17, so as to restore the first bed body raising module 17 to the first height D1. In this way, the mattress module 30 returns to a flat state. The second height D2 can be changed, and is greater than the first height D1.

Moreover, the mattress device 3 further includes a time measurement module 39 which is electrically connected to the control module 31 and is a timer. After receiving the plurality of sensed pressure signals from the pressure sensing module 33 for a predetermined period of time, the control module 31 provides a plurality of pressure adjustment signals to the plurality of pressure adjustment units 321 of the pressure adjustment module 32, so as to adjust pressure values supplied by the pressure adjustment units 321 to the mattress module 30. The predetermined time may be 5 or 10 minutes, and be set by the user personally.

The mattress device 3 further includes a communication module 40, which is electrically connected to the control module 31.

The mattress device 3 may be communicatively connected to a server 9 or a mobile device 8 via the communication module 20. The user may be communicatively connected to the communication module 40 in the mattress device 3 via an APP in the mobile device 9, so as to send a pressure adjustment signal for pressure adjustment.

In this embodiment, the communication module 40 includes a wired communication unit (not shown in the figure) and a wireless communication unit (not shown in the figure). The wired communication unit (not shown in the figure) may also be independently disposed so as to establish a communicative connection with the server 9, and to receive a control signal from the server 9 or data in a database (not shown in the figure).

The wireless communication unit (not shown in the figure) may be a WI-FI® communication unit, a BLUETOOTH® communication unit, a ZIGBEE® communication unit, a LoRa communication unit, a Sigfox communication unit, or an NB-IoT communication unit.

Moreover, the mattress device 3 further includes a storage module 41 used to store various parameters of the mattress device 3. The storage module 41 is a flash memory, a read-only memory, a programmable read-only memory, an electrically rewritable read-only memory, an erasable programmable read-only memory, or an electrically-erasable programmable read-only memory.

Sixth Embodiment

Figure 35:
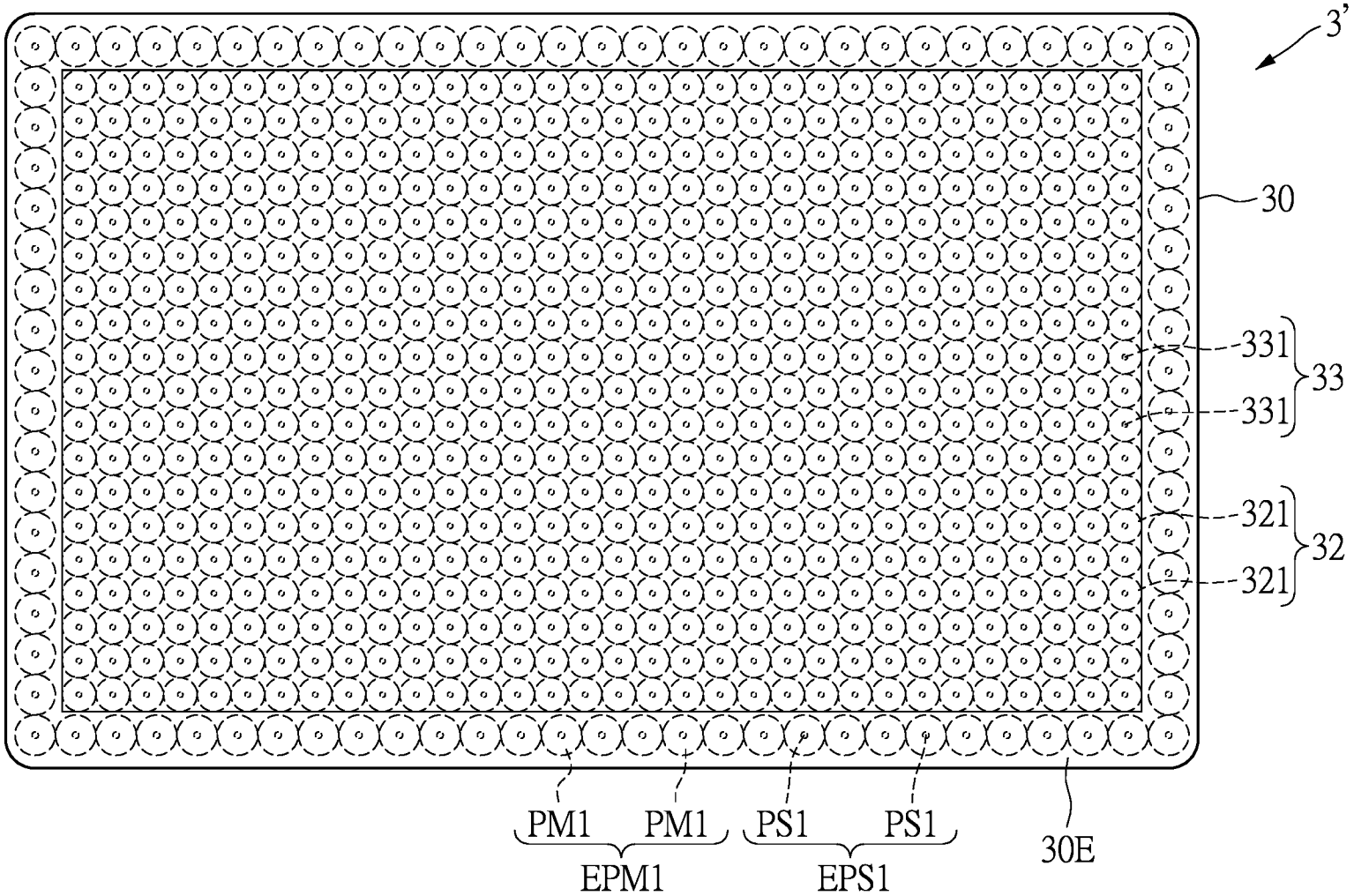
FIG. 35 is a schematic view showing a mattress device having an edge pressure adjustment module disposed in an edge region thereof in the second embodiment of the present disclosure.
Figure 36:
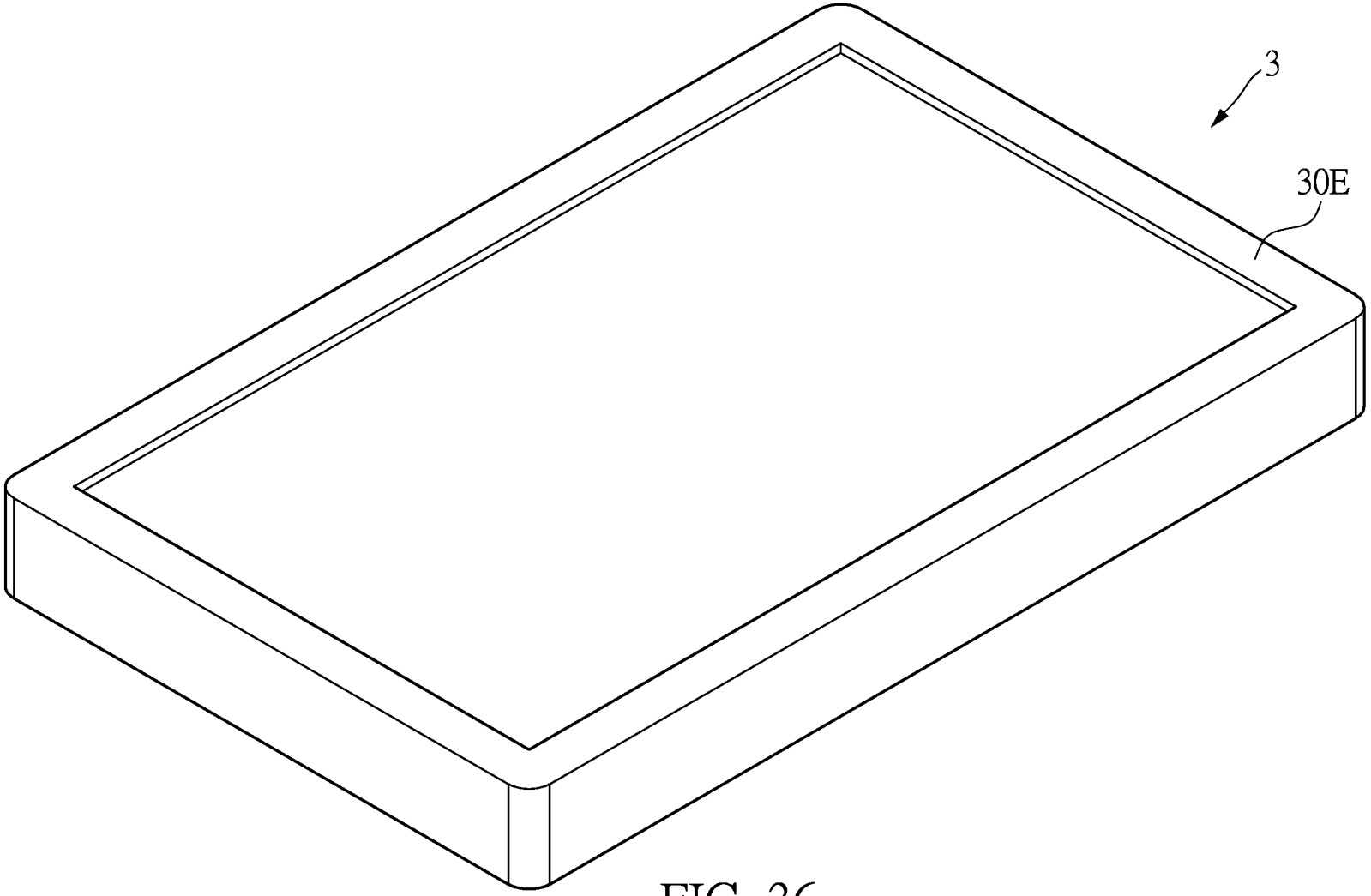
FIG. 36 is a schematic view showing the edge region of the mattress device being higher than a central region in the second embodiment of the present disclosure.
Figure 37:
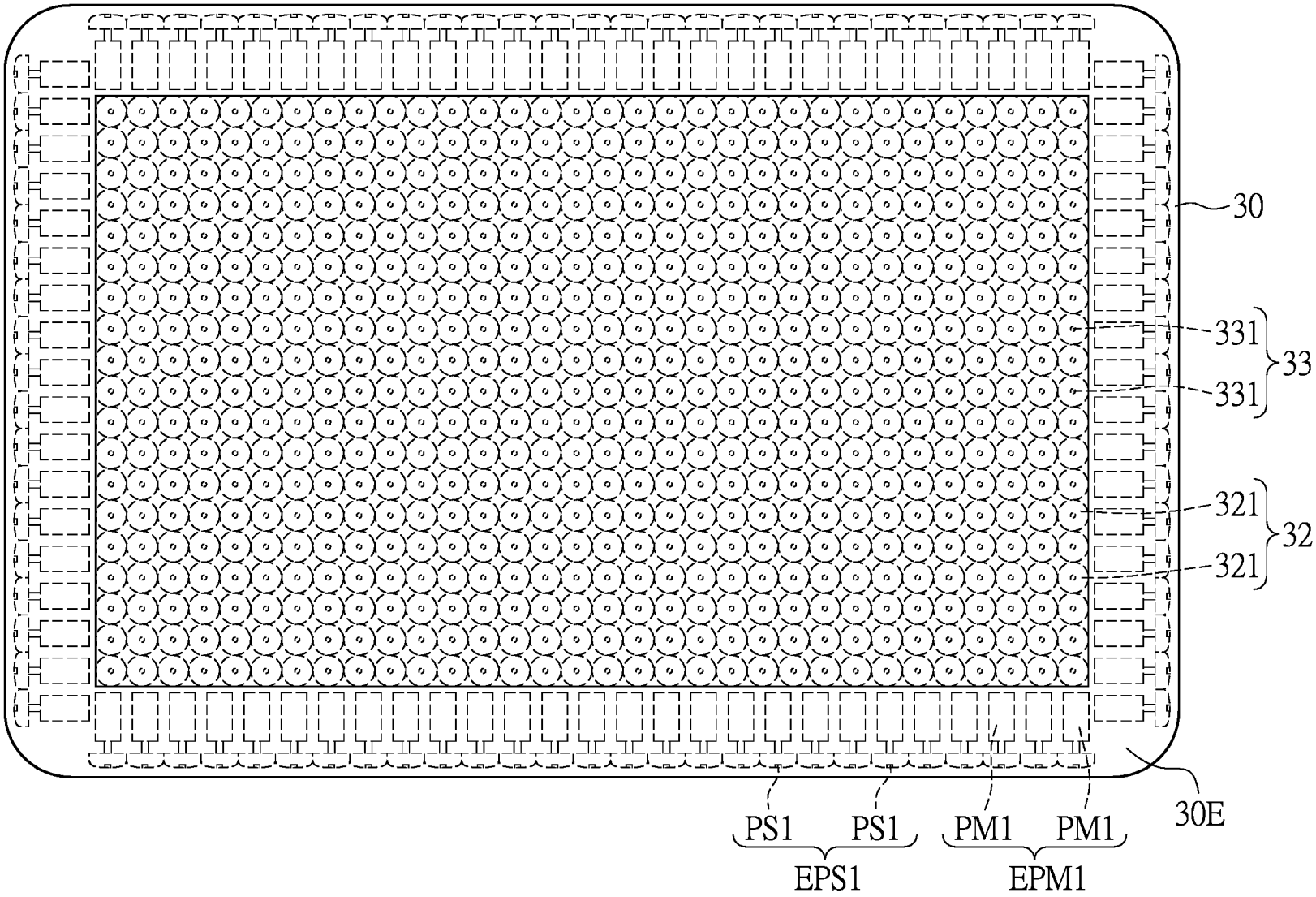
FIG. 37 is another schematic view showing the mattress device having the edge pressure adjustment module disposed in the edge region thereof in the second embodiment of the present disclosure.

Referring to FIGS. 35, 36, and 37, FIG. 35 is a schematic view showing that a mattress device is disposed with an edge pressure adjustment module in an edge region in an embodiment of the present disclosure. FIG. 36 is a schematic view showing that the edge region of the mattress device is higher than a central region in an embodiment of the present disclosure. FIG. 37 is another schematic view showing that the mattress device is disposed with the edge pressure adjustment module in the edge region in an embodiment of the present disclosure.

Referring to FIG. 35, a pressure adjustment module 32 and a pressure sensing module 33 are disposed in a central region of the mattress device 3'. In addition, the edge region 30E of the mattress device 3', namely, the bed frame, has an edge pressure adjustment module EPM1 and an edge pressure sensing module EPS1 disposed therein.

The edge pressure adjustment module EPM1 includes a plurality of edge pressure adjustment units PM1, and the edge pressure adjustment units PM1 and pressure adjustment units 321 all include a micro motor. Likewise, the edge pressure sensing module EPS1 includes a plurality of edge pressure sensing units PS1 each disposed at one side of the corresponding edge pressure adjustment unit PM1. That is, the edge pressure sensing units PS1 collocate with the edge pressure adjustment units PM1 in a one-to-one correspondence manner.

In this embodiment, one to three rows of edge pressure adjustment units PM1 may be arranged in the edge region 30E, so as to improve the lying comfort. In other embodiments, the number of the edge pressure adjustment units PM1 may be adjusted according to practical requirement.

Each edge pressure adjustment unit PM1 includes a micro motor (not shown in the figure), a retractable unit (not shown in the figure), and an elastic unit (not shown in the figure).

The retractable unit (not shown in the figure) is connected onto the micro motor (not shown in the figure) in the edge pressure adjustment unit PM1, and the elastic unit (not shown in the figure) is disposed on the retractable unit (not shown in the figure). In this embodiment, the retractable unit (not shown in the figure) may be adjusted in length by means of a torque change or force output change of the micro motor. In addition, the edge pressure adjustment unit PM1 in the edge region 10E may be designed to extend at different angles, such as a vertical angle, a horizontal angle, or an oblique angle, so that the edge region 10E provides a better comfort.

Referring to FIG. 36, the retractable unit (not shown in the figure) of the edge pressure adjustment unit PM1 disposed in the edge region 30E is flexibly adjusted in length in a vertical direction, and the edge region 30E is higher than the mattress module 10 in the central region.

Referring to FIG. 37, the retractable unit (not shown in the figure) of the edge pressure adjustment unit PM1 disposed in the edge region 30E is flexibly adjusted in length in a horizontal direction, and in this case, the mattress module 30 is horizontally larger than the original size.

If multiple rows of the edge pressure adjustment units PM1 are disposed in the edge region 30E, a small arc-shaped fence is formed around the mattress device 3, so that the user is prevented from falling off the mattress device.

When the user lies on the edge region 30E, the edge pressure sensing units PS1 in the edge region 30E send sensed signals to the control module 31, and then the control module 31 may send an edge control signal to the plurality of edge pressure adjustment units PM1 of the edge pressure adjustment module EPM1, so as to adjust the softness and comfort of the edge region 30E.

In other embodiments, a frame unit (not shown in the figure) may be disposed above the plurality of edge pressure adjustment units PM1. That is, upon receiving the edge control signal from the control module 31, the plurality of edge pressure adjustment units PM1 may drive a gear mechanism, pneumatic device, or hydraulic device to adjust the position of the frame unit (not shown in the figure). In this embodiment, the frame unit (not shown in the figure) is a retractable connected frame tube and is disposed at one side of the edge region 30E. When the frame unit rises, a desired fencing effect is achieved around the mattress device 3. In this way, a young user, for example, a baby, is unlikely to fall off the mattress device 3 when lying thereon. In addition, the frame unit (not shown in the figure) may be disposed in the mattress module 30 or on sides of the mattress module 30.

Advantageous Effects of the Embodiments

One of the advantageous effects of the present disclosure lies in that, the chair device of the present disclosure is provided with a first pressure adjustment module and a second pressure adjustment module that can be adjusted independently in real time, thus improving user experience. In addition, the chair device of the present disclosure can offer different adjustment manners according to different use statuses of the seat module and the back support module, so as to adjust the first pressure adjustment module and the second pressure adjustment module. Moreover, the first pressure adjustment module and the second pressure adjustment module of the present disclosure are densely arranged to provide a wrapping experience for the user.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. A chair device, comprising:

a support stand;

a seat module disposed above the support stand;

a connection module disposed at one side of the seat module;

a back support module connected to the connection module and disposed at one side of the seat module;

a first pressure adjustment module disposed in the seat module;

a second pressure adjustment module disposed in the back support module;

a first pressure sensing module disposed in the seat module;

a second pressure sensing module disposed in the back support module; and a control module electrically connected to the first pressure adjustment module, the second pressure adjustment module, the first pressure sensing module, and the second pressure sensing module;

wherein the control module adjusts the first pressure adjustment module according to a plurality of first sensed pressure signals from the first pressure sensing module, and adjusts the second pressure adjustment module according to a plurality of second sensed pressure signals from the second pressure sensing module, wherein the connection module further includes an angular sensor which is disposed on the connection module and used to detect an included angle between the seat module and the back support module, and wherein, when the included angle is greater than a predetermined angle, the control module simultaneously controls the plurality of first pressure adjustment units of the first pressure adjustment module and the plurality of second pressure adjustment units of the second pressure adjustment module.

2. The chair device of claim 1, wherein the first pressure adjustment module includes a plurality of first pressure adjustment units, and the second pressure adjustment module includes a plurality of second pressure adjustment units; wherein the first pressure sensing module includes a plurality of first pressure sensing units, and the second pressure sensing module includes a plurality of second pressure sensing units; wherein the control module adjusts the plurality of first pressure adjustment units of the first pressure adjustment module according to the plurality of first sensed pressure signals from the plurality of first pressure sensing units of the first pressure sensing module, and also adjusts the plurality of second pressure adjustment units of the second pressure adjustment module according to the plurality of second sensed pressure signals from the plurality of second pressure sensing units of the second pressure sensing module.

3. The chair device of claim 2, wherein each of the first pressure adjustment units and each of the second pressure adjustment units separately include a micro motor, an elastic unit, and a connection unit; wherein a central axis of the micro motor is connected to the connection unit, and the connection unit is connected to the elastic unit.

4. The chair device of claim 2, wherein the seat module includes a comfortable seat material layer and a seat propping material layer, and the back support module includes a comfortable back-support material layer and a back support propping material layer; wherein the first pressure adjustment module and the first pressure sensing module are disposed between the comfortable seat material layer and the seat propping material layer; wherein the second pressure adjustment module and the second pressure sensing module are disposed between the comfortable back-support material layer and the back support propping material layer.

5. The chair device of claim 1, wherein the first pressure adjustment module and the second pressure adjustment module each include a plurality of airbag units and a pump; wherein the plurality of airbag units of the first pressure adjustment module are connected to the pump of the first pressure adjustment module, and the pump of the first pressure adjustment module is used to inflate or deflate each of the plurality of airbag units of the first pressure adjustment module, so as to perform pressure adjustment; wherein the plurality of airbag units of the second pressure adjustment module are connected to the pump of the second pressure adjustment module, and the pump of the second pressure adjustment module is used to inflate or deflate each of the plurality of airbag units of the second pressure adjustment module, so as to preform pressure adjustment.

6. The chair device of claim 5, wherein the seat module includes a comfortable seat material layer and a seat propping material layer, and the back support module includes a comfortable back-support material layer and a back support propping material layer; wherein the first pressure adjustment module and the first pressure sensing module are disposed between the comfortable seat material layer and the seat propping material layer; wherein the second pressure adjustment module and the second pressure sensing module are disposed between the comfortable back-support material layer and the back support propping material layer.

7. The chair device of claim 6, wherein the first pressure adjustment module further includes a plurality of first spherical objects and a plurality of second spherical objects, and the first spherical objects are larger than the second spherical objects; wherein the plurality of first spherical objects are disposed between the plurality of airbag units in a matrix, and the plurality of second spherical objects are disposed on the plurality of airbag units in a matrix, so as to contact the comfortable seat material layer; wherein the second pressure adjustment module further includes a plurality of first spherical objects and a plurality of second spherical objects, and the first spherical objects of the second pressure adjustment module are larger than the second spherical objects; the plurality of first spherical objects of the second pressure adjustment module are disposed between the plurality of airbag units in a matrix; the plurality of second spherical objects of the second pressure adjustment module are disposed on the plurality of airbag units in a matrix, to contact the comfortable back-support material layer.

8. The chair device of claim 1, further comprising a sensor module used to detect first environmental parameters or second environmental parameters of the chair device, wherein, when the included angle between the seat module and the back support module is less than a predetermined angle, the sensor module detects the first environmental parameters of the chair device; wherein, when the included angle between the seat module and the back support module is greater than or equal to the predetermined angle, the sensor module detects the second environmental parameters of the chair device.

9. The chair device of claim 8, wherein the first environmental parameters and the second environmental parameters include at least a vibration status of a mattress module.

10. The chair device of claim 8, wherein the sensor module includes at least a gyro sensor or a vibration sensor.

11. The chair device of claim 10, wherein the sensor module further includes a temperature sensor or a humidity sensor.

12. The chair device of claim 8, further comprising a comfort level analysis module, which is electrically connected to the control module and used to receive the first environmental parameters or the second environmental parameters from the sensor module, wherein the comfort level analysis module determines a comfort level parameter when a user sits in or lies on the chair device according to the first environmental parameters, the second environmental parameters, the plurality of first sensed pressure signals from the plurality of first pressure sensing units of the first pressure sensing module, or the plurality of second sensed pressure signals from the plurality of second pressure sensing units of the second pressure sensing module.

13. The chair device of claim 12, wherein the comfort level analysis module transmits the comfort level parameter to the control module, and the control module adjusts the plurality of first pressure adjustment units of the first pressure adjustment module or the plurality of second pressure adjustment units of the second pressure adjustment module separately.

14. The chair device of claim 1, further comprising a power module and a communication module, wherein the power module is an AC-to-DC voltage converter or a DC-to-AC voltage converter, and the communication module is a wired communication unit or a wireless communication unit; wherein, when the communication module is the wireless communication unit, the communication module is a WI-FI® communication unit, a BLUETOOTH® communication unit, a ZIGBEE® communication unit, a LoRa communication unit, a Sigfox communication unit, or an NB-IoT communication unit.

15. A chair device, comprising:

a first propping structure including a plurality of first propping modules and disposed in the seat module, wherein each of the first propping modules includes a first propping end and a second propping end; wherein the first propping end of any one of the first propping modules is connected to the first propping end or the second propping end of another one of the first propping modules, and the plurality of first propping modules in the first propping structure are mutually connected to form a mesh structure; and a second propping structure, comprising a plurality of second propping modules and disposed in the back support module, wherein each of the second propping modules includes a first propping end and a second propping end; the first propping end of any one of the second propping module is connected to a first propping end or a second propping end of another one of the second propping module; and the plurality of second propping modules in the second propping structure are mutually connected to form a mesh structure.

16. The chair device of claim 15, wherein each of the first propping modules includes an elongated sleeve, a micro motor, and a connection unit; wherein the micro motor of the first propping module is electrically connected to a control module, the micro motor and the connection unit of the first propping module are disposed in the elongated sleeve of the first propping module, and the control module controls the micro motor of the first propping module to adjust a connection length of the corresponding connection unit; wherein each of the second propping modules includes an elongated sleeve, a micro motor, and a connection unit; wherein the micro motor of the second propping module is electrically connected to the control module, the micro motor and the connection unit of the second propping module are disposed in the elongated sleeve of the second propping module, and the control module controls the micro motor of the second propping module to adjust a connection length of the corresponding connection unit.

17. The chair device of claim 16, wherein each first propping module further includes a pressure sensing unit which is disposed on an inner surface or an outer surface of the elongated sleeve of the first propping module; wherein the pressure sensing unit of the first propping module is used to detect a pressure value applied on the corresponding elongated sleeve; wherein the pressure values detected by each of the pressure sensing units is transmitted to the control module, and then the control module adjusts the corresponding micro motor and connection unit of the first propping module according to the pressure values; wherein each of the second propping modules further includes a pressure sensing unit which is disposed on an inner surface or an outer surface of the elongated sleeve of the second propping module; wherein the pressure sensing unit of the second propping module is used to detect a pressure value applied on the corresponding elongated sleeve; wherein the pressure values detected by each pressure sensing unit is transmitted to the control module, and then the control module adjusts the corresponding micro motor and the corresponding connection unit of the second propping module according to the pressure values.

18. The chair device of claim 16, further comprising a power module electrically connected to the control module, the plurality of micro motors of the plurality of first propping modules, and the plurality of micro motors of the plurality of second propping modules, so as to supply power.

19. The chair device of claim 15, wherein the first propping structure further includes a plurality of node connection modules, at least two of the first propping modules are connected via the node connection module, and the seat module is capable of being bent and adjusted at different angles via the plurality of node connection modules; wherein the second propping structure further includes a plurality of node connection modules, at least two of the second propping modules are connected via the node connection module, and the back support module is capable of being bent and adjusted at different angles via the plurality of node connection modules.

20. The chair device of claim 15, wherein the mesh structure formed by connection of the plurality of first propping modules and the mesh structure formed by connection of the plurality of second propping modules each include a connected structure in a triangular shape, a square shape, a rectangular shape, or an irregular shape.

21. A propping device, comprising:

a frame;

a control module; and a plurality of propping modules electrically connected to the control module, wherein each of the propping modules includes a first propping end and a second propping end, the first propping end of each propping module is connected to a first propping end or a second propping end of another propping module, the plurality of propping modules is mutually connected to form a mesh structure, and the control module controls and adjusts a length of each of the propping modules.

* * * * *